United States Patent [19]

Marshall et al.

[11] 4,283,292

[45] * Aug. 11, 1981

[54] SOIL RESISTANT YARN FINISH FOR SYNTHETIC ORGANIC POLYMER YARN

[75] Inventors: Robert M. Marshall, Chester; Kimon C. Dardoufas, Richmond, both of Va.

[73] Assignee: Allied Chemical Corporation, Morris Township, Morris County, N.J.

[ * ] Notice: The portion of the term of this patent subsequent to Mar. 11, 1997, has been disclaimed.

[21] Appl. No.: 102,588

[22] Filed: Dec. 12, 1979

Related U.S. Application Data

[63] Continuation-in-part of Ser. No. 974,203, Dec. 28, 1978, Pat. No. 4,192,754.

[51] Int. Cl.[3] ..... D06M 13/34

[52] U.S. Cl. ..... 252/8.8; 252/8.6; 252/8.7; 8/115.6; 560/87

[58] Field of Search ..... 252/8.8, 8.6, 8.7; 8/115.6; 560/87

[56] References Cited

U.S. PATENT DOCUMENTS

| | | | |
|---|---|---|---|
| 3,781,202 | 12/1973 | Marshall et al. | 252/8.7 |
| 3,894,992 | 7/1975 | Raynolds | 528/401 |
| 3,997,450 | 12/1976 | Steinmiller | 252/8.7 |
| 4,043,923 | 8/1977 | Loudas | 252/8.6 |
| 4,063,024 | 12/1977 | Sandler | 560/87 |
| 4,063,024 | 12/1977 | Sandler | 560/87 |
| 4,134,839 | 1/1979 | Marshall | 252/8.9 |
| 4,190,545 | 2/1980 | Marshall et al. | 560/87 |
| 4,192,754 | 3/1980 | Marshall | 252/8.8 |
| 4,193,880 | 3/1980 | Marshall | 560/87 |

FOREIGN PATENT DOCUMENTS 1040082 8/1966 United Kingdom .

*Primary Examiner*—Joseph L. Schofer
*Assistant Examiner*—Herbert Lilling
*Attorney, Agent, or Firm*—Virginia S. Andrews

[57] ABSTRACT

Emulsion and several spin finishes are disclosed for incorporation with synthetic organic polymer yarn or yarn products to render the same oil repellent and resistant to soiling. The emulsions and spin finishes all include a yarn finish composition which comprises (a) a solution of a salt of dioctyl sulfosuccinate, propylene glycol and water, and (b) a fluorochemical compound consisting of polycarboxybenzene esterified with certain partially fluorinated alcohols and with hydroxyl-containing organic radicals such as 2-hydroxyethyl, glyceryl, and chlorohydryl or bromohydryl.

51 Claims, No Drawings

SOIL RESISTANT YARN FINISH FOR SYNTHETIC ORGANIC POLYMER YARN

CROSS REFERENCE TO RELATED APPLICATIONS

This application is a continuation-in-part of U.S. Application Ser. No. 974,203 filed Dec. 28, 1978, now U.S. Pat. No. 4,192,754.

BACKGROUND OF THE INVENTION

This invention relates to emulsions and spin finishes for incorporation with synthetic organic polymer yarn or yarn products to render the same oil repellent and resistant to soiling.

The treatment of textiles with fluorochemicals to impart oil repellency and soil resistance has been known for some time. U.S. Application Ser. No. 861,372, filed Dec. 16, 1977 U.S. Pat. No. 4,209,610, discloses that polycarboxybenzenes esterified with certain partially fluorinated alcohols and with hydroxyl-containing organic radicals such as 2-hydroxyethyl, glyceryl, and chlorohydryl or bromohydryl, when incorporated with polyethylene terephthalate or synthetic long-chain polyamide fibers as by contact in a liquid medium, concentrate at the fiber surface, especially if the fiber is annealed. A relatively durable oil and water repellency is thus imparted to the fiber. U.S. Pat. No. 4,134,839 to Marshall, hereby incorporated by reference, indicates that the oil repellent fluorocarbon compounds of U.S. Application Ser. No. 861,372 are not compatible with the lubricating oils in spin finishes used in a conventional spin finish, and further, that the emulsifying components of some known spin finishes are not suitable for preparing an oil in water emulsion containing these oil repellent fluorocarbon compounds. U.S. Pat. No. 4,134,839 discloses a spin finish which has the oily properties of a conventional spin finish and which also imparts to the yarn the oil repellent properties of the fluorocarbon finish of U.S. Application Ser. No. 861,372 U.S. Pat. No. 4,209,610. However, we have found that the disclosed spin finish causes serious processing problems when a finish circulating pump is utilized in the finish circulation system of a conventional spinning process, i.e., the fluorocarbon separates, clogs and stops the finish circulating pump. Accordingly, extensive research has been carried out to develop an improved spin finish which possesses the desirable properties of both of the aforementioned applications and which will not gradually separate in the finish circulation system during commercial processing of the yarn. As a by-product of this research, a yarn finish composition has been discovered which, when incorporated with synthetic organic polymer yarn or yarn products, renders the same oil repellent and resistant to soiling.

U.S. Pat. Nos. 3,997,450 to Steinmiller and 4,046,930 to Johnson et al. are believed to be pertinent to the present invention.

SUMMARY OF THE INVENTION

The present invention provides an emulsion, comprising water and a yarn finish composition, for incorporation with synthetic organic polymer yarn or yarn products to render the same oil repellent and resistant to soiling.

The yarn finish composition comprises (a) about 15 to 80 weight percent of a solution of a salt of dioctyl sulfosuccinate, propylene glycol and water; and (b) about 20 to 85 weight percent of a fluorochemical compound. The fluorochemical compound has the formula

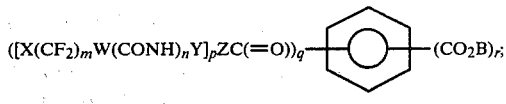

I.

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the same or different.

The solution forming a part of the yarn finish composition preferably consists essentially of about 40 to 90 percent by weight of a salt of dioctyl sulfosuccinate, about 5 to 30 percent by weight of propylene glycol, and about 5 to 30 percent by weight of water.

It is preferred that the emulsion of the present invention comprise approximately 1.5 to 25 percent by weight of the composition. The emulsion can be applied in any known manner to synthetic organic polymer fiber, yarn or yarn products, e.g., by spraying the fiber, yarn or yarn products, or by dipping them into or otherwise contacting them with the emulsion. This emulsion can be applied during spinning of the yarn. with, preferably, a conventional spin finish being applied to the yarn just prior to or subsequent to application of the emulsion, e.g., by tandem (in series) kiss rolls. The emulsion can alternatively be applied as an overfinish during beaming of the yarn or at any other processing stage. Staple fiber can also be treated by spraying. Further, fabric or carpet made from synthetic organic polymer yarn can be treated with the emulsion, e.g., by spraying, padding, or dipping in a conventional manner.

The spin finishes of the present invention comprise a first noncontinuous phase, water, and a second noncontinuous phase. The first noncontinuous phase consists essentially of the yarn finish composition as defined above. The second noncontinuous phase is preferably an emulsion, optionally aqueous, which must be capable of being emulsified with the first non-continuous phase and water without separation of any of the component parts of the spin finish.

The minimum acceptable percentage by weight for the spin finish of the first noncontinuous phase is believed to depend on the maximum temperature exposure measured on the yarn and/or yarn product in processing subsequent to application of the spin finish. For high temperature processing, the spin finish of the present invention comprises about 1.5 to 25 percent, more preferably about 2.4 to 10 percent, by weight of the first noncontinuous phase; about 50 to 96 percent, more preferably about 80 to 93 percent by weight of water; and about 2.5 to 25 percent, more preferably about 5 to 10 percent, by weight of a second noncontinuous phase. By "high temperature" is meant that the yarn and/or yarn product temperature exposure is in excess of 110° C., preferably in the range of about 140° C. to 180° C. Since very little of this spin finish flashes off in high temperature processing, about 0.2 to 1.5 percent by weight of yarn, of oil, is applied as spin finish, and about 0.18 to 1.35 percent by weight of yarn, of oil, remains on the yarn after high temperature processing. A minimum of about 0.075 percent by weight of yarn, of the fluorochemical compound, after high temperature processing of the yarn has been found to provide effective oil repellency and resistance to soiling, especially by oily materials. The most preferred second noncontinuous phase of this spin finish consists essentially of about 20 to 70 percent by weight of coconut oil, about 10 to 50 percent by weight of polyoxyethylene oleyl ether containing about 5 to 20 moles of ethylene oxide per mole of oleyl alcohol, and about 5 to 30 percent by weight of polyoxyethylene stearate containing about 4 to 15 moles of ethylene oxide per mole of stearic acid. The second noncontinuous phase can also consist essentially of a polyalkylene glycol ether. A further second noncontinuous phase of the spin finish consists essentially of about 40 to 65 percent by weight of coconut oil, about 15 to 35 percent by weight of polyoxyethylene oleyl ether containing about 5 to 20 moles of ethylene oxide per mole of oleyl alcohol, about 2 to 10 percent by weight of polyoxyethylene nonyl phenol containing about 5 to 15 moles of ethylene oxide per mole of nonyl phenol, and about 5 to 25 percent by weight of polyoxyethylene stearate containing about 4 to 15 moles of ethylene oxide per mole of stearic acid. Alternatively, the second noncontinuous phase of the spin finish consists essentially of from about 40 to 65 percent by weight of mineral oil, about 5 to 15 percent by weight of a fatty acid soap, about 10 to 25 percent by weight of sulfonated ester ethoxylate, about 5 to 15 percent by weight of polyethylene glycol ester, about 2 to 10 percent by weight of polyethylene glycol ether, and about 0.5 to 2 percent by weight of triethanolamine. Another satisfactory second noncontinuous phase of the spin finish consists essentially of from about 40 to 65 percent by weight of coconut oil, about 15 to 35 percent by weight of polyoxyethylene oleyl ether containing about 8 to 20 moles of ethylene oxide per mole of oleyl alcohol, about 2 to 10 percent by weight of polyoxyethylene oleate containing about 2 to 7 moles of ethylene oxide per mole of oleic acid, and about 5 to 25 percent by weight of polyoxyethylene castor oil containing about 2 to 10 moles of ethylene oxide per mole of castor oil. A further second noncontinuous phase of the spin finish consists essentially of from about 40 to 60 percent by weight of white mineral oil (350 SUS viscosity), about 40 to 60 percent by weight of a salt of polyoxyethylene oleyl phosphate containing about 5 to 9 moles of ethylene oxide per mole of oleyl alcohol, and about 0.5 to 4 percent by weight of a salt of dinonyl sulfosuccinate. Another satisfactory second noncontinuous phase consists essentially of about 40 to 50 percent by weight of an alkyl stearate wherein the alkyl group contains 4 to 18 carbon atoms, about 25 to 30 percent by weight of sorbitan monooleate, and about 25 to 30 percent by weight of polyoxyethylene tallow amine containing about 18 to 22 moles of ethylene oxide per mole of tallow amine. Another second noncontinuous phase of the spin finish consists essentially of about 12 to 45 percent by weight of polyoxyethylene laurate containing about 7 to 12 moles of ethylene oxide per mole of lauric acid, about 15 to 40 percent by weight of polyoxyethylene monoisostearate containing about 7 to 12 moles of ethylene oxide per mole of isostearic acid, about 2 to 8 percent by weight of polyoxyethylene tridecyl ether containing about 3 to 9 moles of ethylene oxide per mole of tridecyl alcohol, about 10 to 35 percent by weight of a salt of polyoxyethylene tridecyl alcohol phosphate containing about 3 to 7 moles of ethylene oxide per mole of tridecyl alcohol, and about 5 to 40 percent by weight of tridecyl stearate.

For low temperature processing, the spin finish of the present invention comprises about 2.6 to 25 percent, more preferably about 3.8 to 10 percent, by weight of the first noncontinuous phase; about 50 to 95 percent, more preferably about 80 to 92 percent, by weight of water; and about 2.5 to 25 percent, more preferably about 5 to 10 percent, by weight of a second noncontinuous phase. By "low temperature" is meant that the yarn and/or yarn product temperature exposure is about 110° C. or less, preferably in the range of about 100° C. to to 110° C. About 0.2 to 1.5 percent by weight of yarn, of oil, is preferably applied as spin finish, and about 0.19 to 1.4 percent by weight of yarn, of oil, remains on the yarn after low temperature processing. As little as about 0.12 percent by weight of yarn, of the fluorochemical compound, after low temperature processing of the yarn has been found to provide effective oil repellency and resistance to soiling, especially by oily materials. The second noncontinuous phases disclosed as suitable for use in the spin finish above are also suitable for use in the present spin finish. However, yarn treated with the spin finish which included as its second noncontinuous phase a polyalkylene glycol ether and subsequently processed at low temperatures could be produced only on a small scale, i.e., not commercially, due to high yarn to metal friction. Similarly, yarn treated with the spin finish which included as its second noncontinuous phase polyoxyethylene laurate, polyoxyethylene monoisostearate, polyoxyethylene tridecyl ether, a salt of polyoxyethylene tridecyl alcohol phosphate and tridecyl stearate, and subsequently processed at high temperatures could only be produced on a small scale, i.e., not commercially, due to high yarn to metal friction.

This invention includes also polyamide and polyester and other synthetic polymer fibers, yarns and yarn products having incorporated therewith the emulsion or spin finishes as above defined.

The spin finishes of the present invention, in addition to rendering yarn treated therewith oil repellent and resistant to soiling, provide lubrication, static protection and plasticity to the yarn for subsequent operations, such as drawing and steam jet texturing and other operations for production of bulked yarn, particularly bulked carpet yarn or textured apparel yarn.

One of the major features of the spin finish of the present invention resides in its exceptional emulsion stability—it does not gradually separate in finish circulation systems that include a finish circulating pump to clog and stop the pump during commercial processing. Naturally, such emulsion stability qualifies the spin finish of the present invention for other, more tolerant operations which require a lower emulsion stability.

Throughout the present specification and claims, the term "yarn" is employed in a general sense to indicate strand material, either textile or otherwise, and including a continuous, often plied, strand composed of fibers or filaments, or a noncontinuous strand such as staple, and the like. The term "yarn" also is meant to include fiber, such as continuous single filaments, of a yarn or individual strands of staple fiber before drafting and spinning into a conventional staple yarn. The term "yarn product" is likewise used in a general sense to indicate the end use of the yarn, and includes both fabrics used in apparel, upholstery, draperies, and similar applications, as well as carpets, either prior to or subsequent to dyeing and/or printing. The phrase "synthetic organic polymer" generally includes any fiber-forming thermoplastic resin, such as polypropylene, polyamide, polyester, polyacrylonitrile and blends thereof. The phrase "during commercial processing of the yarn" refers generally to any yarn process which utilizes a finish circulating pump in its finish circulation system.

DESCRIPTION OF THE PREFERRED EMBODIMENT

The preferred fluorochemical compounds which are useful in the yarn finish composition, emulsion and spin finish of the present invention are trimellitates and pyromellitates. They can be represented by the following formulas, wherein A and A′ represent the same or different radicals $X(CF_2)_mW(CONH)_nY$ of Formula I above, and wherein each A and A′ radical has a main chain containing at least six carbon atoms and contains at least four perfluorinated carbon atoms in the radical. In the following formulas, B is as previously defined with Formula I above and B′ is the same or different radical.

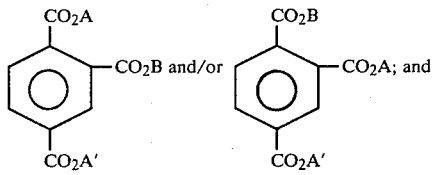

II.

(a) - para (b) - meta

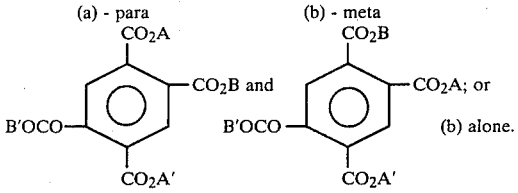

III.

(a) - para (b) - meta

The above fluorinated radicals A, A′ are likewise preferred in the various other compounds of the invention, in particular in bis(diamide)/esters of trimellitic acid and of pyromellitic acid in accordance with this invention.

Fluorochemical compounds which are more particularly preferred are mixtures of substituted pyromellitic acid or trimellitic acid position isomers, especially mixtures of the para and meta pyromellitate position isomers, represented by Formulas III (a) and (b) above, with A=A′ and B=B′, and A containing at least six perfluorinated carbon atoms, and not over four other chain atoms therein; especially such mixtures containing about 50:50 molar proportions of each of the two-position isomers of Formula III. The attachment of the radicals in the para isomer (see Formula III (a) above) is symmetrical with respect to rotation 180 degrees about the axis through the center of the nucleus. This isomer, used alone, shows relatively low repellency. Nevertheless, when the para isomer is mixed in about 50:50 molar ratio with the meta isomer (which is unsymmetrical with respect to rotation about such axis), the mixture shows repellency essentially equal to the good repellency of the substantially pure metal isomer used alone in the same amount. The corresponding bis-(diamide)/-esters of the substituted acids are likewise preferred.

It will be appreciated that although overall the radicals A and A′ will both be the same and the radicals B and B′ will both be the same in the preferred fluorochemical compounds, they may nevertheless vary within individual molecules because a mixture of fluorinated alcohols will generally be used to obtain the fluorinated radicals A, and because epoxides used to obtain the radicals B may react further to form dimers or higher polymers of the B radicals.

In especially preferred radicals A and A′, the fluorinated moiety has the formula $CF_3(CF_2)_m$ or $(CF_3)_2CFO(CF_2)_{m'}$, where m independently at each occurrence has any integral value from 5 to 9, and m′ independently at each occurrence has any integral value from 2 to 16, and $(CF_2)_m$ and $(CF_2)_{m'}$ are straight chains.

Preferred radicals B and B′ are $CH_2CH_2OH$, $CH_2CH(OH)CH_2Cl$, $CH_2CH(OH)CH_2OH$ and $CH_2CH(OH)CH_2Br$.

The fluorinated radicals in the fluorochemical compounds useful in this invention are provided in general by reaction between a benzene polycarboxylic acid anhydride or carboxy chloride/anhydride, which can be additionally substituted in the benzene ring, and an appropriate fluorinated alcohol or amine. The corresponding carboxylic acid/half ester containing a fluorinated esterifying radical and a carboxy group is produced from the anhydride group reacting with an alcohol; or when the compound is an amide rather than an ester, the appropriate fluorinated amine is used as reactant instead of the alcohol, with production of a fluorinated amido group and a carboxy group. All free carboxy groups can then be esterified by base-catalyzed reaction with the epoxide corresponding to the desired "B" group in the compound.

The invention will now be further described in the following specific examples which are to be regarded solely as illustrative and not as restricting the scope of the invention. In particular, although the examples are limited to polyamide and polyester yarns and yarn products, it will be appreciated that the emulsions and spin finishes of the present invention can be applied to yarn made from any synthetic organic polymer filaments and products thereof. Further, although the examples are limited to sodium dioctyl and dinonyl sulfosuccinate, the dioctyl and dinonyl sulfosuccinates useful in this invention are of the salts of dioctyl and dinonyl sulfosuccinates, especially the ammonium salt and the alkali metal, particularly sodium and potassium, salts of a dioctyl or dinonyl ester of sulfosuccinic acid; similarly with respect to the salt of polyoxyethylene oleyl phosphate. In the following examples, parts and percentages employed are by weight unless otherwise indicated.

EXAMPLE 1

The fluorochemical used in this example was a mixture of pyromellitates having the following structure:

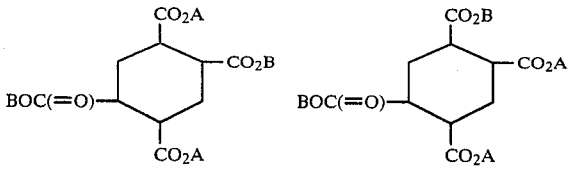

(a) para (50%) (b) meta (50%)

A = $(CH_2)_2(CF_2)_nCF_3$ where n is 5–13
B = $CH_2CHOHCH_2Cl$.

For convenience, this mixture of pyromellitates is hereinafter called Fluorochemical Composition-1. About 70 parts of Fluorochemical Composition-1 were added to 30 parts of a solution which consisted essentially of about 70 percent by weight of sodium dioctyl sulfosuccinate, about 16 percent by weight of propylene glycol and about 14 percent by weight of water. This solution is manufactured under the trade name of Aerosol OT-70-PG and obtainable from the American Cyanamid Company, Industrial Chemical Division, Process Chemicals Department, Wayne, N.J. 07470. The Fluorochemical Composition-1 and solution were heated to 80° C. at which temperature the Fluorochemical Composition-1 melted and formed a clear homogeneous first noncontinuous phase. This first noncontinuous phase was then added to 800 parts of water heated to about 80° C., and the mixture was agitated to form an emulsion, which was then cooled to about 60° C. The oil particles in this emulsion had a particle size of less than one micron, and the emulsion was stable for at least 30 days without signs of separation. For convenience, this emulsion is called Emulsion-1.

It should be noted that in forming Emulsion-1 or the first noncontinuous phase above, Fluorochemical Composition-1 and the solution can be heated to a temperature of between approximately 80° C. and 95° C. The temperature of the water should correspond approximately to that of the first noncontinuous phase when it is added to the water. The resultant emulsion can be cooled to a temperature between approximately 50° C. and 85° C.

To Emulsion-1 was added 100 parts of a second noncontinuous phase consisting essentially of about 55 percent by weight of coconut oil, about 25 percent by weight of polyoxyethylene oleyl ether containing about 10 moles of ethylene oxide per mole of oleyl alcohol, about 5 percent by weight of polyoxyethylene nonyl phenol containing about 9 moles of ethylene oxide per mole of nonyl phenol, and about 15 percent by weight of polyoxyethylene stearate containing about 8 moles of ethylene oxide per mole of stearic acid. The resulting emulsion was stable for at least 30 days and was suitable for use as a spin finish as described hereinafter. For convenience, this emulsion is called Spin Finish-1.

EXAMPLE 2

The procedure of Example 1 is followed except that 70 parts of Fluorochemical Composition-1, 30 parts of the solution, and 400 parts of water are used to form an emulsion, which is called Emulsion-2. The oil particles in this emulsion have a particle size of less than one micron, and the emulsion is stable for at least 30 days without signs of separation.

Emulsion-2 is then blended with 500 parts of another oil in water emulsion containing 20 percent of an oil composition consisting essentially of about 55 percent by weight of coconut oil, about 25 percent by weight of polyoxyethylene oleyl ether containing about 10 moles of ethylene oxide per mole of oleyl alcohol, about 5 percent by weight of polyoxyethylene nonyl phenol containing about 9 moles of ethylene oxide per mole of nonyl phenol, and about 15 percent by weight of polyoxyethylene stearate containing about 8 moles of ethylene oxide per mole of stearic acid. The resulting emulsion is stable for at least 30 days and is suitable for use as a spin finish as described hereinafter. For convenience this emulsion is called Spin Finish-2. Spin Finish-1 and Spin Finish-2 may be used in the same manner to coat yarn during or subsequent to spinning.

EXAMPLE 3

This example demonstrates use of Spin Finish-1 of the present invention in a conventional spin-draw process for production of a polyamide yarn suitable for processing into bulked yarn that is oil repellent and resistant to soiling, especially by oily materials.

A typical procedure for obtaining polymer pellets for use in this example is as follows. A reactor equipped with a heater and stirrer is charged with a mixture of 1,520 parts of epsilon-caprolactam and 80 parts of aminocaproic acid. The mixture is then flushed with nitrogen and stirred and heated to 255° C. over a one-hour period at atmospheric pressure to produce a polymerization reaction. The heating and stirring is continued at atmospheric pressure under a nitrogen sweep for an additional four hours in order to complete the polymerization. Nitrogen is then admitted to the reactor and a small pressure is maintained while the polycaproamide polymer is extruded from the reactor in the form of a polymer ribbon. The polymer ribbon is subsequently cooled, pelletized, washed and dried. The polymer is a white solid having a relative viscosity of about 50 to 60 as determined at a concentration of 11 grams of polymer in 100 ml. of 90 percent formic acid at 25° C. (ASTM D-789-62T).

Polyamide polymer pellets prepared in accordance, generally, with the procedure above were melted at about 285° C. and melt extruded under pressure of about 1,500 psig. through a 70-orifice spinnerette to produce an undrawn yarn having about 3,600 denier. Spin Finish-1 of Example 1 was applied to the yarn as a spin finish in amount to provide about 1.0 percent by weight of oil on the yarn. The yarn was then drawn at about 3.2 times the extruded length and textured with a steam jet at a temperature of 140° C. to 180° C. (high temperature) to produce a bulked yarn that is particularly useful for production of carpets and upholstery fabrics.

In the finish circulation system, a finish circulating pump pumped Spin Finish-1 from a supply tank into a tray in which a kiss roll turned to pick up finish for application to the moving yarn in contact with the kiss roll. Finish from the tray overflowed into the supply tank. There was no separation of Spin Finish-1 in the finish circulation system.

The bulked yarn was visually inspected for mechanical quality after spinning and steam jet texturing. The visual inspection sighting was perpendicular to the wraps of yarn on a tube forming a yarn package. The rating was from 1 to 5 wherein 5 was excellent and represented no visible broken filaments, wherein 1 was poor and represented a fuzzy appearance due to a large number of broken filaments, and wherein 4 through 2 represented increasing numbers of broken filaments. Bulked yarn made in accordance with this example had a mechanical quality rating of 5.

The bulked yarn was made into a fabric by conventional means and evaluated for oil repellency by AATCC Test No. 118-1975 which involved wetting the fabric by a selected series of liquid hydrocarbons of different surface tensions. The test liquids were as follows:

| Oil Repellency Rating Number | Test Liquid |
|---|---|
| 1 | "Nujol" |
| 2 | 65:35 "Nujol" n-hexadecane by volume |
| 3 | n-Hexadecane |
| 4 | n-Tetradecane |
| 5 | n-Dodecane |
| 6 | n-Decane |
| 7 | n-Octane |
| 8 | n-Heptane |

"Nujol" is the trademark of Plough, Inc. for a mineral oil having a Saybolt viscosity 360/390 at 38° C. and a specific gravity 0.880/0.900 at 15° C.

In the test, one test specimen, approximately 20×20 cm., was conditioned for a minimum of four hours at 21±1° C. and 65±2 percent relative humidity prior to testing. The test specimen was then placed on a smooth, horizontal surface and, beginning with the lowest numbered test liquid, a small drop—approximately 5 mm. in diameter (0.05 ml. volume)—was placed with a dropping bottle pipette on the test specimen in several locations. The drop was observed for 30 seconds at an angle of approximately 45 degrees.

If no penetration or wetting of the fabric at the liquid-fabric interface and no wicking around the drop occurred, a drop of the next higher-numbered test liquid was placed at a site adjacent on the fabric to the first drop, again observing the drop for 30 seconds. This procedure was continued until one of the test liquids showed obvious wetting of the fabric under or around the drop within 30 seconds.

The fabric made from polyamide yarn prepared in accordance with the present example had an oil repellency of 5-6.

EXAMPLE 4

There are three stages at which emulsion stability was measured. The first stage was after the initial oil in water emulsion was formed with Fluorochemical Composition-1. The second stage was after the second emulsion, optionally aqueous, had been added to the initial oil in water emulsion. And the third stage occurred during processing of the yarn when the spin finish was in a finish circulation system which utilized a finish circulating pump.

This example illustrates the importance of the particular emulsifier chosen with respect to the first stage, i.e., the stability of the initial oil in water emulsion formed with Fluorochemical Composition-1. Table 1 lists the formulations tested for emulsion stability, sixteen of which (formulations A, B, C, D, E, F, U, V, W, X, A', B', C', E', F', and G') exhibited excellent emulsion stability after 72 hours.

With the exception of formulation D, all of the formulations had as one of their constituents a sulfosuccinate diester. With respect to this group of formulations, it can be seen that the sodium dioctyl sulfosuccinate and propylene glycol of the solution (Aerosol OT-70-PG; see Example 1) were apparently both necessary to the stable emulsification of Fluorochemical Composition-1. This is highlighted by a comparison of, for example, formulations A, B and C (of the present invention) with, respectively, formulations P, Q and R, and further, with formulation T (necessity of sodium dioctyl sulfosuccinate), and by a comparison of, for example, formulation A with formulations G, I, M and S (necessity of propylene glycol). Especially worthy of note is the noninterchangeability of sodium dioctyl sulfosuccinate and sodium dinonyl sulfosuccinate with respect to this first stage, as evidenced by the poor stabilities of formulations S and T when compared with, respectively, formulations E and C. This is unusual in light of the first-stage stabilities of formulations A, B, C, E and F.

TABLE 1

EMULSION STABILITY DATA

| | Formulation | | | | | | | | | |
|---|---|---|---|---|---|---|---|---|---|---|
| Component* | A | B | C | D | E | F | G | H | I | J |
| 1 | 5.0 | 6.0 | 7.0 | 5.0 | 5.0 | 5.0 | 5.0 | 5.0 | 5.0 | 5.0*** |
| 2 | 5.0 | 4.0 | 3.0 | — | — | — | — | — | — | — |
| 3 | — | — | — | — | — | — | 5.0 | — | — | — |
| 4 | — | — | — | — | — | — | — | 5.0 | — | — |
| 5 | — | — | — | — | — | — | — | — | 5.0 | — |
| 6 | — | — | — | — | — | — | — | — | — | 5.0 |
| 7 | — | — | — | — | — | — | — | — | — | — |
| 8 | — | — | — | — | — | — | — | — | — | — |
| 9 | — | — | — | — | — | — | — | — | — | — |
| 10 | — | — | — | 5.0 | — | — | — | — | — | — |
| 11 | — | — | — | — | 5.0 | — | — | — | — | — |
| 12 | — | — | — | — | — | 5.0 | — | — | — | — |
| 13 | — | — | — | — | — | — | — | — | — | — |
| 14 | — | — | — | — | — | — | — | — | — | — |
| 15 | — | — | — | — | — | 5.0 | — | — | — | — |
| 16 | — | — | — | — | — | 5.0 | — | — | — | — |
| 17 | 90.0 | 90.0 | 90.0 | 90.0 | 90.0 | 80.0 | 90.0 | 90.0 | 90.0 | 90.0 |
| Emulsion Stability After 72 Hours** | E | E | E | E | E | E | P | P | P | P |
| Component* | K | L | M | N | O | P | Q | R | S | T |

TABLE 1-continued

EMULSION STABILITY DATA

| | | | | | | | | | | |
|---|---|---|---|---|---|---|---|---|---|---|
| 1 | 5.0 | 5.0 | 5.0 | 5.0 | 5.0 | 5.0 | 6.0 | 7.0 | 5.0 | 7.0*** |
| 2 | — | — | — | 2.5 | — | — | — | — | — | — |
| 3 | — | 2.5 | 2.5 | — | — | — | — | — | — | — |
| 4 | — | 2.5 | — | 2.5 | — | — | — | — | — | — |
| 5 | — | — | 2.5 | — | — | — | — | — | — | — |
| 6 | — | — | — | — | — | — | — | — | — | — |
| 7 | 5.0 | — | — | — | — | — | — | — | — | — |
| 8 | — | — | — | — | 5.0 | — | — | — | — | — |
| 9 | — | — | — | — | — | 5.0 | 4.0 | 3.0 | — | — |
| 10 | — | — | — | — | — | — | — | — | — | — |
| 11 | — | — | — | — | — | — | — | — | — | — |
| 12 | — | — | — | — | — | — | — | — | — | — |
| 13 | — | — | — | — | — | — | — | — | 5.0 | — |
| 14 | — | — | — | — | — | — | — | — | — | 3.0 |
| 15 | — | — | — | — | — | — | — | — | — | — |
| 16 | — | — | — | — | — | — | — | — | — | — |
| 17 | 90.0 | 90.0 | 90.0 | 90.0 | 90.0 | 90.0 | 90.0 | 90.0 | 90.0 | 90.0 |
| Emulsion Stability After 72 Hours** | P | P | P | P | P | P | P | P | P | P |

| Component* | U | V | W | X | Y | Z | A' | B' | C' | D' |
|---|---|---|---|---|---|---|---|---|---|---|
| 1 | 4.5 | 2.7 | 1.8 | 4.5 | 5.4 | 6.8 | 3.6 | 2.7 | 1.8 | 6.1*** |
| 2 | 2.2 | 1.3 | 0.9 | 1.9 | 2.3 | 2.9 | 1.6 | 1.2 | 0.8 | 2.6 |
| 3 | — | — | — | — | — | — | — | — | — | — |
| 4 | — | — | — | — | — | — | — | — | — | — |
| 5 | — | — | — | — | — | — | — | — | — | — |
| 6 | — | — | — | — | — | — | — | — | — | — |
| 7 | — | — | — | — | — | — | — | — | — | — |
| 8 | — | — | — | — | — | — | — | — | — | — |
| 9 | — | — | — | — | — | — | — | — | — | — |
| 10 | — | — | — | — | — | — | — | — | — | — |
| 11 | — | — | — | — | — | — | — | — | — | — |
| 12 | — | — | — | — | — | — | — | — | — | — |
| 13 | — | — | — | — | — | — | — | — | — | — |
| 14 | — | — | — | — | — | — | — | — | — | — |
| 15 | — | — | — | — | — | — | — | — | — | — |
| 16 | — | — | — | — | — | — | — | — | — | — |
| 17 | 93.3 | 96.0 | 97.3 | 93.6 | 92.3 | 90.3 | 94.8 | 96.1 | 97.4 | 91.3 |
| Emulsion Stability After 72 Hours** | E | E | E | E | F | F | E | E | E | F |

| Component* | E' | F' | G' |
|---|---|---|---|
| 1 | 3.6 | 4.6 | 2.7*** |
| 2 | 1.8 | 2.2 | 1.4 |
| 3 | — | — | — |
| 4 | — | — | — |
| 5 | — | — | — |
| 6 | — | — | — |
| 7 | — | — | — |
| 8 | — | — | — |
| 9 | — | — | — |
| 10 | — | — | — |
| 11 | — | — | — |
| 12 | — | — | — |
| 13 | — | — | — |
| 14 | — | — | — |
| 15 | — | — | — |
| 16 | — | — | — |
| 17 | 94.6 | 93.2 | 95.9 |
| Emulsion Stability After 72 | | | |

TABLE 1-continued

| EMULSION STABILITY DATA | | | |
|---|---|---|---|
| Hours** | E | E | E |

Footnotes to Table 1.
*Number corresponds to footnote.
**Emulsion stability after 72 hours; E = Excellent - no separation, translucent; F = Fair - no separation, milky/cloudy; and P = Poor - separation.
***Parts by weight.
1. Fluorochemical Composition-1.
2. Aerosol OT-70-PG. American Cyanamid's trade name for solution of Example 1.
3. Aerosol OT-S. American Cyanamid's trade name for solution consisting of 70 percent sodium dioctyl sulfosuccinate and 30 percent petroleum distillate.
4. Aerosol TR-70. American Cyanamid's trade name for solution consisting of 70 percent sodium di(-tridecyl($C_{13}$))sulfosuccinate, 20 percent ethanol, and 10 percent water.
5. Aerosol GPG. American Cyanamid's trade name for solution consisting of 70 percent sodium dioctyl sulfosuccinate, 7 percent ethanol, and 23 percent water.
6. Aerosol AY. American Cyanamid's trade name for waxy solid consisting of 100 percent sodium diamyl ($C_5$) sulfosuccinate.
7. Aerosol 1B. American Cyanamid's trade name for solution consisting of 45 percent sodium dibutyl($C_4$-)sulfosuccinate and 55 percent water.
8. Nekal WS-25. GAF's trade name for solution consisting of 75 percent sodium dinonyl sulfosuccinate, 10 percent isopropanol, and 15 percent water.
9. Aerosol A-196 Extruded-Modified. Aerosol A-196 Extruded is American Cyanamid's trade name for a solid consisting of sodium di(cyclohexyl)sulfosuccinate. Modified - a solution is formed consisting of 70 percent sodium (di(cyclohexyl)sulfosuccinate, 16 percent propylene glycol, and 14 percent water.
10. Alkanol Amide. Alkanol amide resulting from reaction of coco fatty acid containing about 6 to 18 carbon atoms and diethanol amine.
11. Nonhomogeneous Mixture-1. Consisting of 60 percent sodium dinonyl sulfosuccinate, 20 percent dimethyl naphthalene sodium sulfonate, and 20 percent ammonium perfluoroalkyl carboxylate.
12. Nonhomogeneous Mixture-2. Consisting of 40 percent sodium dinonyl sulfosuccinate, 20 percent dimethyl naphthalene sodium sulfonate, and 40 percent ammonium perfluoroalkyl carboxylate.
13. Nonhomogeneous Mixture-3. Consisting of approximately 60 percent dodium dioctyl sulfosuccinate, 20 percent dimethyl naphthalene sodium sulfonate, and 20 percent ammonium perfluoroalkyl carboxylate.
14. Solution. Consisting of 70 percent sodium dinonyl sulfosuccinate, 16 percent propylene glycol, and 14 percent water.
15. POE(4) Lauryl Ether. Four moles of ethylene oxide per mole of lauryl alcohol.
16. Coconut Oil.
17. Water.

EXAMPLE 5

The procedure of Example 1 was followed except that the 100 parts of the second noncontinuous phase which was added to Emulsion-1 consisted essentially of about 55 percent by weight of mineral oil, about 11 percent by weight of a fatty acid soap, about 15 percent by weight of a sulfonated ester ethoxylate, about 12 percent by weight of polyethylene glycol ester, about 6 percent by weight of polyethylene glycol ether, and about 1 percent by weight of triethanolamine. The resulting emulsion was stable for at least 30 days and was suitable for use as a spin finish as described hereinafter. For convenience, this emulsion is called Spin Finish-3.

EXAMPLE 6

The procedure of Example 2 is followed except that the 500 parts of the oil in water emulsion with which Emulsion-2 is blended contains 20 percent of an oil composition consisting essentially of about 55 percent by weight of mineral oil, about 11 percent by weight of a fatty acid soap, about 15 percent by weight of a sulfonated ester ethoxylate, about 12 percent by weight of a polyethylene glycol ester, about 6 percent by weight of polyethylene glycol ether, and about 1 percent by weight of triethanolamine. The resulting emulsion is stable for at least 30 days and is suitable for use as a spin finish as described hereinafter. For convenience, this emulsion is called Spin Finish-4. Spin Finish-3 and Spin Finish-4 may be used in the same manner to coat yarn during and subsequent to spinning.

EXAMPLE 7

This example demonstrates use of Spin Finish-3 of the present invention in a conventional spin-draw process for production of a polyamide yarn suitable for processing into bulked yarn that is oil repellent and resistant to soiling, especially by oily materials.

The procedure of Example 3 was followed with the substitution of Spin Finish-3 of Example 5 for Spin Finish-1. There was no separation of Spin Finish-3 in the finish circulation system. Bulked yarn made in accordance with this example had a mechanical quality rating of 4. Fabric made from polyamide yarn prepared in accordance with the present example had an oil repellency of 5–6.

EXAMPLE 8

The procedure of Example 1 was followed except that the 100 parts of the second noncontinuous phase which was added to Emulsion-1 consisted essentially of about 55 percent by weight of coconut oil, about 25 percent by weight of polyoxyethylene oleyl ether containing about 10 moles of ethylene oxide per mole of oleyl alcohol, about 5 percent by weight of polyoxyethylene oleate containing about 5 moles of ethylene oxide per mole of oleic acid, and about 15 percent by weight of polyoxyethylene castor oil containing about 5 moles of ethylene oxide per mole of castor oil. The resulting emulsion was stable for at least 30 days and was suitable for use as a spin finish as described hereinafter. For convenience, this emulsion is called Spin Finish-5.

EXAMPLE 9

The procedure of Example 2 is followed except that the 500 parts of the oil in water emulsion with which Emulsion-2 is blended contains 20 percent of an oil composition consisting essentially of about 55 percent by weight of coconut oil, about 25 percent by weight of polyoxyethylene oleyl ether containing about 10 moles of ethylene oxide per mole of oleyl alcohol, about 5 percent by weight of polyoxyethylene oleate containing about 5 moles of ethylene oxide per mole of oleic acid, and about 15 percent by weight of polyoxyethylene castor oil containing about 5 moles of ethylene oxide per mole of castor oil. The resulting emulsion is stable for at least 30 days and is suitable for use as a spin finish as described hereinafter. For convenience, this emulsion is called Spin Finish-6. Spin Finish-5 and Spin Finish-6 may be used in the same manner to coat yarn during and subsequent to spinning.

EXAMPLE 10

This example demonstrates use of Spin Finish-5 of the present invention in a conventional spin-draw process for production of a polyamide yarn suitable for processing into bulked yarn that is oil repellent and resistant to soiling, especially by oily materials.

The procedure of Example 3 was followed with the substitution of Spin Finish-5 of Example 8 for Spin Finish-1. There was no separation of Spin Finish-5 in the finish circulation system. Bulked yarn made in accordance with this example had a mechanical quality rating of 3. Fabric made from polyamide yarn prepared in accordance with the present example had an oil repellency of 5–6.

EXAMPLE 11

The procedure of Example 1 was followed except that the 100 parts of the second noncontinuous phase which was added to Emulsion-1 consisted essentially of about 50 percent by weight of white mineral oil (350 SUS viscosity), about 48 percent by weight of sodium salt of polyoxyethylene oleyl phosphate containing about 7 moles of ethylene oxide per mole of oleyl alcohol, and about 2 percent by weight of sodium dinonyl sulfosuccinate. The resulting emulsion was stable for at least 7 days. For convenience, this emulsion is called Spin Finish-7.

EXAMPLE 12

The procedure of Example 2 is followed except that the 500 parts of the oil in water emulsion with which Emulsion-2 is blended contains 20 percent of an oil composition consisting essentially of about 50 percent by weight of white mineral oil (350 SUS viscosity), about 48 percent by weight of sodium salt of polyoxyethylene oleyl phosphate containing about 7 moles of ethylene oxide per mole of oleyl alcohol, and about 2 percent by weight of sodium dinonyl sulfosuccinate. The resulting emulsion is stable for at least 7 days. For convenience, this emulsion is called Spin Finish-8. Spin Finish-7 and Spin Finish-8 may be used in the same manner to coat yarn during and subsequent to spinning.

EXAMPLE 13

Spin Finish-7 of Example 11 was tested for emulsion stability in a finish circulating pump. Spin Finish-7 did not separate.

EXAMPLE 14

The procedure of Example 1 was followed except that the 100 parts of the second noncontinuous phase which was added to Emulsion-1 consisted essentially of about 44.5 percent by weight of butyl stearate, about 27.75 percent by weight of sorbitan monooleate, and about 27.75 percent by weight of polyoxyethylene tallow amine containing about 20 moles of ethylene oxide per mole of tallow amine. The resulting emulsion was stable for at least 7 days. For convenience, this emulsion is called Spin Finish-9.

EXAMPLE 15

The procedure of Example 2 is followed except that the 500 parts of the oil in water emulsion with which Emulsion-2 is blended contains 20 percent of an oil composition consisting essentially of about 44.5 percent by weight of butyl stearate, about 27.75 percent by weight of sorbitan monooleate, and about 27.75 percent by weight of polyoxyethylene tallow amine containing about 20 moles of ethylene oxide per mole of tallow amine. The resulting emulsion is stable for at least 7 days. For convenience, this emulsion is called Spin Finish 10. Spin Finish-9 and Spin Finish-10 may be used in the same manner to coat yarn during and subsequent to spinning.

EXAMPLE 16

Spin Finish-9 of Example 14 was tested for emulsion stability in a finish circulating pump. Spin Finish-9 did not separate.

EXAMPLE 17 (COMPARATIVE)

About 50 parts of Fluorochemical Composition-1 were added to 50 parts to an alkanol amide resulting from the reaction of coco fatty acid (containing about 6 to 18 carbon atoms) and diethanolamine, and the mixture was heated to 80° C. at which temperature the Fluorochemical Composition-1 melted and formed a clear homogeneous mixture. This oil was then added to 800 parts of water heated to about 80° C., and the mixture was agitated to form an emulsion, which was then cooled to about 60° C. The oil particles in this emulsion had a particle size of less than one micron, and the emulsion was stable for more than thirty days without signs of separation. This emulsion was then blended with 100 parts of an oil composition consisting of about 44.5 percent by weight of butyl stearate, about 27.75 percent by weight of sorbitan monooleate, and about 27.75 percent by weight of polyoxyethylene tallow amine containing about 20 moles of ethylene oxide per mole of tallow amine. (Reference U.S. Pat. No. 4,134,839 to Marshall). The resulting emulsion was stable for at least 30 days. For convenience, this emulsion is called Spin Finish 11.

The procedure of Example 3 was followed with the substitution of Spin Finish-11 for Spin Finish-1. Spin Finish-11 gradually separated in the finish circulation system during processing of the yarn and stopped the finish circulating pump. Bulked yarn made in accordance with this example prior to stoppage of the pump had a mechanical quality rating of 1. Fabric made from polyamide yarn prepared in accordance with this example (prior to pump stoppage) had an oil repellency of 6.

EXAMPLE 18 (COMPARATIVE)

The procedure of Example 1 was followed except that the 100 parts of the second noncontinuous phase which was added to Emulsion-1 consisted essentially of about 59 percent by weight of coconut oil, about 15.5 percent by weight of polyoxyethylene castor oil containing about 25 moles of ethylene oxide per mole of castor oil, about 7.5 percent by weight of decaglycerol tetraoleate, about 3 percent by weight of glycerol monooleate, about 5 percent by weight of polyoxyethylene sorbitan monooleate containing about 20 moles of ethylene oxide per mole of sorbitan monooleate, and about 10 percent by weight of sulfonated petroleum product. (Reference U.S. Pat. No. 3,781,202 to Marshall et al., hereby incorporated by reference). The resulting emulsion separated and was not further evaluated.

EXAMPLE 19 (COMPARATIVE)

The procedure of Example 1 was followed except that the 100 parts of the second noncontinuous phase which was added to Emulsion-1 consisted essentially of about 60 percent by weight of refined coconut glyceride, about 30 percent by weight of polyoxyethylene hydrogenated castor oil containing about 16 moles of ethylene oxide per mole of hydrogenated castor oil, and about 10 percent by weight of potassium salt of polyoxyethylene tridecyl phosphate containing about 5 moles of ethylene oxide per mole of tridecyl alcohol. (Reference U.S. Pat. No. 4,126,564 to Marshall et al., hereby incorporated by reference). The resulting emulsion separated and was not further evaluated.

EXAMPLE 20 (COMPARATIVE)

About 50 parts of Fluorochemical Composition-1 were added to a nonhomogeneous mixture consisting essentially of about 30 parts sodium dinonyl sulfosuccinate, 10 parts dimethyl naphthalene sodium sulfonate, and 10 parts ammonium perfluoroalkyl carboxylate. The mixture was heated to 80° C., at which temperature the Fluorochemical Composition-1 melted and formed a clear homogeneous mixture. The oil was then added to 800 parts of water heated to about 80° C., and the mixture was agitated to form an emulsion which was then cooled to about 60° C. The oil particles in this emulsion had a particle size of less than one micron, and the emulsion was stable for more than 30 days without signs of separation. This emulsion was then blended with 100 parts of an oil composition consisting essentially of about 60 percent by weight of refined coconut glyceride, about 30 percent by weight of polyoxyethylene hydrogenated castor oil containing about 16 moles of ethylene oxide per mole of hydrogenated castor oil, and about 10 percent by weight of potassium salt of polyoxyethylene tridecyl phosphate containing about 5 moles of ethylene oxide per mole of tridecyl alcohol. The resulting emulsion was stable for at least 30 days. For convenience, this emulsion is called Spin Finish-12.

The procedure of Example 3 was followed with the substitution of Spin Finish-12 for Spin Finish-1. Spin Finish-12 separated in the finish circulation system during commercial processing of the yarn and stopped the finish circulating pump. Bulked yarn made in accordance with this example prior to stoppage of the pump had a mechanical quality rating of 3. Fabric made from polyamide yarn prepared in accordance with this example (prior to pump stoppage) had an oil repellency of 1, due to the presence of hydrogenated castor oil.

EXAMPLE 21 (COMPARATIVE)

An initial emulsion was formed according to the procedure of Example 20. This emulsion was then blended with 100 parts of the oil composition (second noncontinuous phase) of Example 18. The resulting emulsion separated and was not evaluated further.

EXAMPLE 22 (COMPARATIVE)

About 50 parts of Fluorochemical Composition-1 were added to a nonhomogeneous mixture consisting essentially of about 20 parts sodium dinonyl sulfosuccinate, 10 parts dimethyl naphthalene sodium sulfonate, 20 parts ammonium perfluoroalkyl carboxylate, 50 parts polyoxyethylene lauryl ether containing 4 moles of ethylene oxide per mole of lauryl alcohol, and 50 parts of coconut oil. The mixture was heated to 80° C., at which temperature the Fluorochemical Composition-1 melted and formed a clear homogeneous mixture. This oil was then added to 800 parts of water heated to about 80° C., and the mixture was agitated to form an emulsion, which was then cooled to about 60° C. The oil particles in this emulsion had a particle size of less than 3 microns and the emulsion was stable for more than seven days without signs of separation. For convenience, this emulsion is called Spin Finish-13.

The procedure of Example 3 was followed with the substitution of Spin Finish-13 for Spin Finish-1. Spin Finish-13 separated in the finish circulation system during processing of the yarn and stopped the finish circulating pump. Bulked yarn made in accordance with this example prior to stoppage of the pump had a mechanical quality rating of 3. Fabric made from polyamide yarn prepared in accordance with this example (prior to pump stoppage) had an oil repellency of 5–6.

EXAMPLE 23 (COMPARATIVE)

An oil in water emulsion was prepared which was identical to Emulsion-2 of Example 2. For convenience, this emulsion is called Spin Finish-14.

The procedure of Example 3 was followed with the substitution of Spin Finish 14 for Spin Finish-1. The yield of yarn was almost zero due to great difficulty in stringing up the drawtist equipment. Further, bulked yarn made in accordance with this example had a mechanical quality rating of 1. Fabric made from polyamide yarn prepared in accordance with this example had an oil repellency of 5–6.

EXAMPLE 24 (CONTROL-1)

The procedure of Example 3 is followed except that the spin finish of U.S. Pat. No. 4,126,564 was substituted for Spin Finish-1. Bulked yarn made in accordance with this example had a mechanical quality rating of 5. Fabric made from polyamide yarn prepared in accordance with this example had an oil repellency of zero.

EXAMPLE 25 (CONTROL-2)

The procedure of Example 3 is followed except that the spin finish of U.S. Pat. No. 3,781,202 is substituted for Spin Finish-1. Bulked yarn made in accordance with this example has an acceptable mechanical quality rating. However, fabric made from polyamide yarn prepared in accordance with this example is not oil repellent.

EXAMPLES 26–39

About 70 parts of Fluorochemical Composition-1 are added to 30 parts of a solution (Aerosol OT-70-PG) which consists essentially of about 70 percent by weight of sodium dioctyl sulfosuccinate, about 16 percent by weight of propylene glycol and about 14 percent by weight of water. The Fluorochemical Composition-1 and solution are heated to 80° C., at which temperature the Fluorochemical Composition-1 melts and forms a clear homogeneous noncontinuous phase. This noncontinuous phase is then added to 900 parts of water which has been heated to about 80° C., and the mixture is agitated to form an emulsion, which is then cooled to room temperature (about 28° C.). The oil particles in this emulsion have a particle size of less than one micron, and the emulsion is stable for at least 30 days without signs of separation. For convenience, this emulsion is called Emulsion-3.

EXAMPLE 26 (COMPARATIVE)

Polyamide polymer pellets prepared in accordance, generally, with the procedure set forth in Example 3, were melted at about 285° C. and were melt extruded under pressure of about 1,500 psig. through a 70-orifice spinnerette to produce an undrawn yarn having about 3,600 denier. Emulsion-3 was applied to the yarn via a first kiss roll in amount to provide about 0.35 percent by weight of oil on the yarn. A spin finish was applied to the yarn via a second kiss roll immediately subsequent to application of Emulsion-3, in amount to provide about 0.8 percent by weight of oil on the yarn. The spin finish applied by the second kiss roll was an oil in water emulsion of about 20 percent by weight of the oil portion. The oil portion consisted essentially of about 60 percent by weight of refined coconut glyceride, about 30 percent by weight of polyoxyethylene hydrogenated castor oil containing about 16 moles of ethylene oxide per mole of hydrogenated castor oil, and about 10 percent by weight of potassium salt of polyoxyethylene tridecyl phosphate containing about 5 moles of ethylene oxide per mole of tridecyl alcohol. The yarn was then drawn at about 3.2 times the extruded length and textured with a steam jet at a temperature of 140° C. to 180° C. to produce a bulked yarn that is particularly useful for production of carpets and upholstery fabrics.

The bulked yarn was visually inspected for mechanical quality after spinning and steam jet texturing as outlined in Example 3. Bulked yarn made in accordance with this example had a mechanical quality rating of 4.

The bulked yarn was made into a fabric by conventional means and was evaluated for oil repellency by AATCC Test No. 118-1975, as set forth in Example 3. The fabric made from polyamide yarn prepared in accordance with the present example had an oil repellency of zero, due to the presence of hydrogenated castor oil.

EXAMPLE 27 (COMPARATIVE)

The procedure of Example 26 is followed except that the spin finish is applied via the first kiss roll and Emulsion-3 is applied via the second kiss roll. The yarn mechanical quality rating and fabric oil repellency value are similar to Example 26.

EXAMPLES 28–29

The procedure of Example 26 is followed except that the oil portion of the spin finish consists of about 44.5 percent by weight of butyl stearate, about 27.75 percent by weight of sorbitan monooleate, and about 27.75 percent by weight of polyoxyethylene tallow amine containing about 20 moles of ethylene oxide per mole of tallow amine. In Example 28, the spin finish is applied via the second kiss roll, and in Example 29, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLES 30–31

The procedure of Example 26 is followed except that the oil portion of the spin finish consists of about 55 percent by weight of mineral oil, about 11 percent by weight of a fatty acid soap, about 15 percent by weight of a sulfonated ester ethoxylate, about 12 percent by weight of polyethyene glycol ester, about 6 percent by weight of polyethylene glycol ether, and about 1 percent by weight of triethanolamine. In Example 30, the spin finish is applied via the second kiss roll, and in Example 31, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLES 32–33

The procedure of Example 26 is followed except that the oil portion of the spin finish consists of about 55 percent by weight of coconut oil, about 25 percent by weight of polyoxyethylene oleyl ether containing about 10 moles of ethylene oxide per mole of oleyl alcohol, about 5 percent by weight of polyoxyethylene oleate containing about 5 moles of ethylene oxide per mole of oleic acid, and about 15 percent by weight of polyoxyethylene castor oil containing about 5 moles of ethylene oxide per mole of castor oil. In Example 32, the spin finish is applied via the second kiss roll, and in Example 33, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLES 34–35

The procedure of Example 26 is followed except that the oil portion of the spin finish consists of about 59 percent by weight of coconut oil, about 15.5 percent by weight of polyoxyethylene castor oil containing about 25 moles of ethylene oxide per mole of castor oil, about 7.5 percent by weight of decaglycerol tetraoleate, about 3 percent by weight of glycerol monooleate, about 5 percent by weight of polyoxyethylene sorbitan monooleate containing about 20 moles of ethylene oxide per mole of sorbitan monooleate and about 10 percent by weight of sulfonated petroleum product. In Example 34, the spin finish is applied via the second kiss roll, and in Example 35, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLES 36–37

The procedure of Example 26 is followed except that the oil portion of the spin finish consists of about 55 percent by weight of coconut oil, about 25 percent by weight of polyoxyethylene oleyl ether containing about 10 moles of ethylene oxide per mole of oleyl alcohol, about 5 percent by weight of polyoxyethylene nonyl phenol containing about 9 moles of ethylene oxide per mole of nonyl phenol, and about 15 percent by weight of polyoxyethylene stearate containing about 8 moles of ethylene oxide per mole of stearic acid. In Example 36, the spin finish is applied via the second kiss roll, and in Example 37, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLES 38–39

The procedure of Example 26 is followed except that the oil portion of the spin finish consists of about 50 percent by weight of white mineral oil (350 SUS viscosity), about 48 percent by weight of sodium salt of polyoxyethylene oleyl phosphate containing about 7 moles of ethylene oxide per mole of oleyl alcohol, and about 2 percent by weight of sodium dinonyl sulfosuccinate. In Example 38, the spin finish is applied via the second kiss roll, and in Example 39, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLE 40

Polyethylene terephthalate pellets are melted at about 290° C. and are melt extruded under a pressure of about 2500 psig. through a 34-orifice spinnerette to produce a partially oriented yarn having about 250 denier. Spin Finish-1 of Example 1 is applied to the yarn as a spin finish via a kiss roll in amount to provide about 0.6 percent by weight of oil on the yarn. The yarn is then draw-textured at about 1.3 times the extruded length and at a temperature of 150° C. to 175° C. to produce a bulked yarn having a drawn denier of about 150. Yarn produced in this manner is particularly useful for production of carpets and fine apparel. Bulked yarn made in accordance with this example has an acceptable mechanical quality rating. In accordance with the procedure of Example 3, the bulked yarn of this example is made into fabric for evaluation of oil repellency. Fabric so produced is oil repellent.

EXAMPLES 41–44

The procedure of Example 40 is followed except that in lieu of Spin Finish-1 are substituted Spin Finish-3 of Example 5, Spin Finish-5 of Example 8, Spin Finish-7 of Example 11, and Spin Finish-9 of Example 14 in each of, respectively, Examples 41, 42, 43 and 44. Bulked yarn made in accordance with each of these examples has an acceptable mechanical quality rating. Fabric made from polyethylene terephthalate yarn prepared in accordance with each of these examples is oil repellent.

EXAMPLE 45 (COMPARATIVE)

Polyethylene terephthalate pellets are melted at about 290° C. and are melt extruded under a pressure of about 2500 psig. through a 34-orifice spinnerette to produce a partially oriented yarn having about 250 denier. Emulsion-3 (of Examples 26–39) is applied to the yarn via a first kiss roll, and the spin finish of Example 26 is applied to the yarn via a second kiss roll immediately subsequent to application of Emulsion 3, in amount to provide a total of about 0.6 percent by weight of oil on the yarn. The yarn is then draw-textured at about 1.3 times the extruded length and at a temperature of 150° C. to 175° C. to produce a bulked yarn having a drawn denier of about 150. Yarn produced in this manner is particularly useful for production of carpets and fine apparel. Bulked yarn made in accordance with this example has an acceptable mechanical quality rating. In accordance with the procedure of Example 3, the bulked yarn of this example is made into fabric for evaluation of oil repellency. Fabric so produced is not oil repellent due to the presence of hydrogenated castor oil.

EXAMPLE 46 (COMPARATIVE)

The procedure of Example 45 is followed except that the spin finish is applied via the first kiss roll and Emulsion-3 is applied via the second kiss roll. The yarn mechanical quality rating is acceptable; however, the fabric is not oil repellent.

EXAMPLES 47–48

The procedure of Example 45 is followed except that the oil portion of the spin finish is as set forth in Examples 28–29. In Example 47, the spin finish is applied via the second kiss roll, and in Example 48, the spin finish is applied via the first kiss roll. Bulked yarn made in accordance with each of these examples has an acceptable mechanical quality rating. Fabric made from polyethylene terephthalate yarn prepared in accordance with each of these examples is oil repellent.

EXAMPLES 49–50

The procedure of Example 45 is followed except that the oil portion of the spin finish is as set forth in Examples 30–31. In Example 49, the spin finish is applied via the second kiss roll, and in Example 50, the spin finish is applied via the first kiss roll. Bulked yarn made in accordance with each of these examples has an acceptable mechanical quality rating. Fabric made from polyethylene terephthalate yarn prepared in accordance with each of these examples is oil repellent.

EXAMPLES 51–52

The procedure of Example 45 is followed except that the oil portion of the spin finish is as set forth in Examples 32–33. In Example 51, the spin finish is applied via the second kiss roll, and in Example 52, the spin finish is applied via the first kiss roll. Bulked yarn made in accordance with each of these examples has an acceptable mechanical quality rating. Fabric made from polyethylene terephthalate yarn prepared in accordance with each of these examples is oil repellent.

EXAMPLES 53–54

The procedure of Example 45 is followed except that the oil portion of the spin finish is as set forth in Examples 34–35. In Example 53, the spin finish is applied via the second kiss roll, and in Example 54, the spin finish is applied via the first kiss roll. Bulked yarn made in accordance with each of these examples has an acceptable mechanical quality rating. Fabric made from polyethylene terephthalate yarn prepared in accordance with each of these examples is oil repellent.

EXAMPLES 55–56

The procedure of Example 45 is followed except that the oil portion of the spin finish is as set forth in Examples 36–37. In Example 55, the spin finish is applied via the second kiss roll, and in Example 56, the spin finish is applied via the first kiss roll. Bulked yarn made in accordance with each of these examples has an acceptable mechanical quality rating. Fabric made from polyethylene terephthalate yarn prepared in accordance with each of these samples is oil repellent.

EXAMPLES 57–58

The procedure of Example 45 is followed except that the oil portion of the spin finish is as set forth in Examples 38–39. In Example 57, the spin finish is applied via the second kiss roll, and in Example 58, the spin finish is applied via the first kiss roll. Bulked yarn made in accordance with each of these examples has an acceptable mechanical quality rating. Fabric made from polyethylene terephthalate yarn prepared in accordance with each of these examples is oil repellent.

EXAMPLE 59

About 70 parts of Fluorochemical Composition-1 are added to 30 parts of the solution (Aerosol OT-70-PG) of Example 1, and the two are heated to 80° C., at which temperature the Fluorochemical Composition melts and forms a clear homogeneous yarn finish composition. This composition is sprayed onto 7-inch polyamide staple fiber, which has a denier per filament of 17 and which is produced by a conventional spinning and staple processing operation, prior to baling. Alternatively, Emulsions 2 and 3 or Spin Finishes 1 to 10 could be substituted for Emulsion 1 and sprayed on the fiber. When no pump is used, the finishes which stopped pumps, described in the above examples, could also be used. The yarn is subsequently heat set and made into carpets by conventional means. Carpet made in accordance with this example is oil repellent.

EXAMPLE 60

The procedure of Example 59 is followed except that the yarn is polyethylene terephthalate staple fiber which has a denier per filament of 12. Carpet made in accordance with this procedure is also oil repellent.

EXAMPLE 61

Polyamide woven fabric is dipped into a pad box containing Emulsion-3 of Examples 26–39 diluted to 1 percent solids. The fabric is squeezed between a steel and a hard rubber roll with sufficient pressure to obtain a 50 percent wet pickup on the weight of the fabric. The fabric is then cured for 1 minute at 150° C. in a circulating air oven. The fluorine content of the finished fabric is 0.17 percent. This is Sample Number 1. This procedure is repeated, utilizing a polyethylene terephthalate fabric, which is Sample Number 2. After a standard home laundering, the oil repellency of both Sample Numbers 1 and 2, as measured by AATCC Test No. 118-1975 set forth in Example 3, is 6.

EXAMPLE 62

About 42.2 parts of Fluorochemical Composition-1 were added to 20.8 parts of the solution (Aerosol OT-70-PG) of Example 1, and the two were heated to 93° C. at which temperature the Fluorochemical Composition-1 melted and formed a clear homogeneous first noncontinuous phase. This first noncontinuous phase was added to 875.5 parts of water at about 83° C. under strong agitation to form an emulsion which were then cooled to about 60° C. The oil particles in this emulsion had a particle size of less than one micron, and the emulsion was staple for at least 30 days without signs of separation. This emulsion is called Emulsion-4.

To Emulsion-4 was added 61.5 parts of a second noncontinuous phase which had been heated to about 60° C. The second noncontinuous phase consisted essentially of about 50 percent by weight of coconut oil, about 30 percent by weight of polyoxyethylene oleyl ether containing about 10 moles of ethylene oxide per mole of oleyl alcohol, and about 20 percent by weight of polyoxyethylene stearate containing about 8 moles of ethylene oxide per mole of stearic acid. The resulting emulsion was stable for at least 30 days and was suitable for use as a spin finish as described hereinafter. This emulsion is called Spin Finish-15.

EXAMPLE 63

The procedure of Example 62 is followed except that 42.2 parts of Fluorochemical Composition-1, 20.8 parts of the solution, and 629.5 parts of water are used to form an emulsion, which is called Emulsion-5. The oil particles in this emulsion have a particle size of less than one micron, and the emulsion is stable for at least 30 days without signs of separation.

Emulsion-5 is then blended with 307.5 parts of another oil in water emulsion containing 20 percent of an oil composition consisting essentially of about 50 percent by weight of coconut oil, about 30 percent by weight of polyoxyethylene oleyl ether containing about 10 moles of ethylene oxide per mole of oleyl alcohol, and about 20 percent by weight of polyoxyethylene stearate containing about 8 moles of ethylene oxide per mole of stearic acid. The resulting emulsion is stable for at least 30 days and is suitable for use as a spin finish as described hereinafter. This emulsion is called Spin Finish-16. Spin Finish-15 and Spin Finish-16 may be used in the same manner to coat yarn during or subsequent to spinning.

EXAMPLE 64

This example demonstrates use of Spin Finish-15 of the present invention in a conventional spin-draw high temperature process for production of a polyamide yarn suitable for processing into bulked yarn that is oil repellent and resistant to soiling especially by oily materials.

The procedure of Example 3 was followed with the substitution of Spin Finish-15 of Example 62 for Spin Finish-1. Spin Finish-15 was applied to the yarn at about 4.8 to 5.0 percent wet pickup to achieve about 0.2 percent by weight of yarn, of the fluorochemical compound, of the yarn after high temperature processing. There was no separation of Spin Finish-15 in the finish circulation system. Bulked yarn made in accordance with this example had a very good mechnical quality rating. Fabric made from polyamide yarn prepared in accordance with the present example had an oil repellency of 5–6.

EXAMPLE 65

Polycaproamide polymer, having about 27±1 amine end groups and about 20 carboxyl end groups, a formic acid viscosity of about 55±2.0 and an extractables level of less than about 2.8 percent, was supplied at a rate of about 125 pounds per hour per spinnerette (250 pounds per hour per position) to a spinning position which comprised two spin pots each containing one spinnerette. Each spinnerette had 300 y-shaped orifices. The filaments were extruded from each spinnerette into a quench stack for cross flow quenching. Each end of quenched filaments had Spin Finish-15 applied at about 4.8 to 5 percent wet pickup, and subsequently was deposited in a tow can. The undrawn denier per filament of the yarn was about 50, and the modification ratio was between about 2.9 to 3.4. Subsequently, yarn from several tow cans was combined in a creel into a tow and stretched in a normal manner at a stretch ratio of about 2.9 in a tow stretcher. The tow was then fed through a stuffing box crimper using 10 pounds of steam to produce about 11 crimps per inch and deposited in an autoclave cart for batch crimp setting at about 107° to 113° C. (225° to 235° F.). At the end of the autoclave cycle, the tow was fed into a conventional cutter, was cut into staple yarn, had a lubricating overfinish applied (Quadralube L100AX, Manufacturers Chemicals Corporation, P.O. Box 197, Cleveland, Tennessee 37311), and was baled. It is believed that the maximum temperature exposure measured on the yarn would be 110° C. or less; in this regard, the above-described process is deemed "low temperature".

In the finish circulation system, a finish circulating pump pumped Spin Finish-15 from a supply tank into a tray in which a kiss roll turned to pick up finish for application to the moving yarn in contact with the kiss roll. Finish from the tray overflowed into the supply tank. There was no separation of Spin Finish-15 in the finish circulation system.

The cut staple yarn was made into a carpet by conventional means and evaluated for oil repellency by AATCC Test No. 118-1975 as outlined in Example 3. The carpet made from polyamide yarn prepared in accordance with the present example had an oil repellency of 5–6.

EXAMPLE 66

The procedure of Example 62 was followed except that the second noncontinuous phase was the same as in Example 1. The resulting emulsion was stable for at least 30 days and was suitable for use as a spin finish as described hereinafter. This emulsion is called Spin Finish-17.

EXAMPLE 67

The procedure of Example 63 is followed except that the 307.5 parts of the oil in water emulsion with which Emulsion-5 is blended contains 20 percent of an oil composition which is the same as that of Example 2. The resulting emulsion is stable for at least 30 days and is suitable for use as a spin finish as described hereinafter. This emulsion is called Spin Finish-18. Spin Finish-17 and Spin Finish-18 may be used in the same manner to coat yarn during and subsequent to spinning.

EXAMPLE 68

The procedure of Example 64 was followed with the substitution of Spin Finish-17 of Example 66 for Spin Finish-15 in the high temperature spin-draw process. Spin Finish-17 was applied to the yarn at about 4.8 to 5.0 percent wet pickup to achieve about 0.2 percent by weight of yarn, of the fluorochemical compound, on the yarn after high temperature processing. There was no separation of Spin Finish-17 in the finish circulation system. Bulked yarn made in accordance with this example had a very good mechanical quality rating. Fabric made from polyamide yarn prepared in accordance with the present example had an oil repellency of 5–6.

EXAMPLE 69

The procedure of Example 65 was followed with the substitution of Spin Finish-17 of Example 66 for Spin Finish-15 in the low temperature process. There was no separation of Spin Finish-17 in the finish circulation system, and carpet made from polyamide yarn prepared in accordance with the present example had an oil repellency of 5–6.

EXAMPLE 70

The procedure of Example 62 was followed except that the second noncontinuous phase consisted essentially of about 32 percent by weight of polyoxyethylene laurate containing about 9 moles of ethylene oxide per mole of lauric acid, about 27 percent by weight of polyoxyethylene monoisostearate containing about 9 moles of ethylene oxide per mole of isostearic acid, about 5 percent by weight of polyoxyethylene tridecyl ether containing about 6 moles of ethylene oxide per mole of tridecyl alcohol, about 27 percent by weight of potassium salt of polyoxyethylene tridecyl alcohol phosphate containing about 5 moles of ethylene oxide per mole of tridecyl alcohol, and about 9 percent by weight of tridecyl stearate. Further, the second noncontinuous phase was added after Emulsion-4 had been cooled to room temperature, i.e., less than 30° C. The resulting emulsion was stable for at least 30 days and was suitable for use as a spin finish as described hereinafter. This emulsion is called Spin Finish-19.

EXAMPLE 71

The procedure of Example 63 is followed except that the 307.5 parts of the oil in water emulsion with which Emulsion-5 is blended contains 20 percent of an oil composition which is the same as the second noncontinuous phase of Example 70. The resulting emulsion is stable for at least 30 days and is suitable for use as a spin finish as described hereinafter. This emulsion is called Spin Finish-20. Spin Finish-19 and Spin Finish-20 may be used in the same manner to coat yarn during and subsequent to spinning.

EXAMPLE 72

The procedure of Example 64 was followed with the substitution of Spin Finish-19 of Example 70 for Spin Finish-15 in the high temperature spin-draw process. Spin Finish-19 was applied to the yarn at about 4.8 to 5.0 percent wet pickup to achieve about 0.2 percent by weight of yarn, of the fluorochemical compound, on the yarn after high temperature processing. There was no separation of Spin Finish-19 in the finish circulation system. Yarn bearing this finish could only be produced in this high temperature process on a small scale, i.e., not commercially, due to high yarn to metal friction; thus, bulked yarn made in accordance with this example had a very poor mechanical quality rating. Fabric made from polyamide yarn prepared in accordance with the present example had an oil repellency of 5–6.

EXAMPLE 73

The procedure of Example 65 was followed with the substitution of Spin Finish-19 of Example 70 for Spin Finish-15 in the low temperature process. There was no separation of Spin Finish-19 in the finish circulation system, and carpet made from polyamide yarn prepared in accordance with the present example had an oil repellency of 5–6.

EXAMPLE 74

The procedure of Example 62 was followed except that the second noncontinuous phase consisted essentially of UCON 50-HB-100, a polyalkylene glycol ether, manufactured by Union Carbide Corporation. The second noncontinuous phase was added after Emulsion-4 had been cooled to room temperature, i.e., less than 30° C. The resulting emulsion was stable for at least 30 days and was suitable for use as a spin finish as described hereinafter. This emulsion is called Spin Finish-21.

EXAMPLE 75

The procedure of Example 63 is followed except that the 307.5 parts of the oil in water emulsion with which Emulsion-5 is blended contains 20 percent of an oil composition which is the same as the second noncontinuous phase of Example 74. The resulting emulsion is stable for at least 30 days and is suitable for use as a spin finish as described hereinafter. This emulsion is called Spin Finish-22. Spin Finish-21 and Spin Finish-22 may be used in the same manner to coat yarn during and subsequent to spinning.

EXAMPLE 76

The procedure of Example 64 was followed with the substitution of Spin Finish-21 of Example 74 for Spin Finish-15 in the high temperature spin-draw process. Spin Finish-21 was applied to the yarn at about 4.8 to 5.0 percent wet pickup to achieve about 0.2 percent by weight of yarn, of the fluorochemical compound, on the yarn after high temperature processing. There was no separation of Spin Finish-21 in the finish circulation system. Bulked yarn made in accordance with this example had a very good mechanical quality rating. Fabric made from polyamide yarn prepared in accordance with the present example had an oil repellency of 6.

EXAMPLE 77

The procedure of Example 65 was followed with the substitution of Spin Finish-21 of Example 74 for Spin Finish-15 in the low temperature process. There was no separation of Spin Finish-21 in the finish circulation system. Yarn bearing this finish could only be produced in this low temperature process on a small scale, i.e., not commercially, due to high yarn to metal friction. However, carpet made from polyamide yarn prepared in accordance with the present example had an oil repellency of 5–6.

EXAMPLE 78

About 25.5 parts of Fluorochemical Composition-1 were added to 12.5 parts of the solution (Aerosol OT-70-PG) of Example 1, and the two were heated to 93° C. at which temperature the Fluorochemical Composition-1 melted and formed a clear homogeneous first noncontinuous phase. This first noncontinuous phase was added to 900 parts of water at about 83° C. under strong agitation to form an emulsion, which was then cooled to about 60° C. The oil particles in this emulsion had a particle size of less than one micron, and the emulsion was stable for at least 30 days without signs of separation. This emulsion is called Emulsion-6.

To Emulsion-6 was added 62 parts of a second noncontinuous phase which had been heated to about 60° C. The second noncontinuous phase consisted essentially of about 50 percent by weight of coconut oil, about 30 percent by weight of polyoxyethylene oleyl ether containing about 10 moles of ethylene oxide per mole of oleyl alcohol, and about 20 percent by weight of polyoxyethylene stearate containing about 8 moles of ethylene oxide per mole of stearic acid. The resulting emulsion was stable for at least 30 days and was suitable for use as a spin finish as described hereinafter. This emulsion is called Spin Finish-23.

EXAMPLE 79

The procedure of Example 78 is followed except that 25.5 parts of Fluorochemical Composition-1, 12.5 parts of the solution, and 652 parts of water are used to form an emulsion, which is called Emulsion-7. The oil particles in this emulsion have a particle size of less than one micron, and the emulsion is stable for at least 30 days without signs of separation.

Emulsion-7 is then blended with 310 parts of another oil in water emulsion containing 20 percent of an oil composition consisting essentially of about 50 percent by weight of coconut oil, about 30 percent by weight of polyoxyethylene oleyl ether containing about 10 moles of ethylene oxide per mole of oleyl alcohol, and about 20 percent by weight of polyoxyethylene stearate containing about 8 moles of ethylene oxide per mole of stearic acid. The resulting emulsion is stable for at least 30 days and is suitable for use as a spin finish as described hereinafter. This emulsion is called Spin Finish-24. Spin-Finish-23 and Spin Finish-24 may be used in the same manner to coat yarn during or subsequent to spinning.

EXAMPLE 80

The procedure of Example 64 was followed with the substitution of Spin Finish-23 of Example 78 for Spin Finish-15 in the high temperature spin-draw process. Spin Finish-23 was applied to the yarn at about 4.8 to 5.0 percent wet pickup to achieve about 0.12 percent by weight of yarn, of the fluorochemical compound, on the yarn after high temperature processing. There was no separation of Spin Finish-23 in the finish circulation system. Bulked yarn made in accordance with this example had a very good mechanical quality rating. Fabric made from polyamide yarn prepared in accordance with the present example had an oil repellency of 5–6.

EXAMPLE 81

The procedure of Example 65 was followed with the substitution of Spin Finish-23 of Example 78 for Spin Finish-15 in the low temperature process. There was no separation of Spin Finish-23 in the finish circulation system, and carpet made from polyamide yarn prepared in accordance with the present example had an oil repellency of 5–6.

EXAMPLE 82

About 17 parts of Fluorochemical Composition-1 were added to 8.4 parts of the solution (Aerosol OT-70-PG) of Example 1, and the two were heated to 93° C. at which temperature with Fluorochemical Composition-1 melted and formed a clear homogeneous first noncontinuous phase. This first noncontinuous phase was added to 913.1 parts of water about 83° C. under strong agitation to form an emulsion, which was then cooled to about 60° C. The oil particles in this emulsion had a particle size of less than one micron, and the emulsion was stable for at least 30 days without signs of separation. This emulsion is called Emulsion-8.

To Emulsion-8 was added 61.5 parts of a second noncontinuous phase which had been heated to about 60° C. The second noncontinuous phase consisted essentially of about 50 percent by weight of coconut oil, about 30 percent by weight of polyoxyethylene oleyl ether containing about 10 moles of ethylene oxide per mole of oleyl alcohol, and about 20 percent by weight of polyoxyethylene stearate containing about 8 moles of ethylene oxide per mole of stearic acid. The resulting emulsion was stable for at least 30 days and was suitable for use as a spin finish as described hereinafter. This emulsion is called Spin Finish-25.

EXAMPLE 83

The procedure of Example 82 is followed except that 17 parts of Fluorochemical Composition-1, 8.4 parts of the solution, and 667.1 parts of water are used to form an emulsion, which is called Emulsion-9. The oil particles in this emulsion have a particle size of less than one micron, and the emulsion is stable for at least 30 days without signs of separation.

Emulsion-9 is then blended with 307.5 parts of another oil in water emulsion containing 20 percent of an oil composition consisting essentially of about 50 percent by weight of coconut oil, about 30 percent by weight of polyoxyethylene oleyl ether containing about 10 moles of ethylene oxide per mole of oleyl alcohol, and about 20 percent by weight of polyoxyethylene stearate containing about 8 moles of ethylene oxide per mole of stearic acid. The resulting emulsion is stable for at least 30 days and is suitable for use as a spin finish as described hereinafter. This emulsion is called Spin Finish-26. Spin Finish-25 and Spin Finish-26 may be used in the same manner to coat yarn during or subsequent to spinning.

EXAMPLE 84

The procedure of Example 64 was followed with the substitution of Spin Finish-25 of Example 82 for Spin Finish-15 in the high temperature spin-draw process. Spin Finish-25 was applied to the yarn at about 4.8 to 5.0 percent wet pickup to achieve about 0.075 percent by weight of yarn, of the fluorochemical compound, on the yarn after high temperature processing. There was no separation of Spin Finish-25 in the finish circulation system. Bulked yarn made in accordance with this example had a very good mechanical quality rating. Fabric made from polyamide yarn prepared in accordance with the present example had an oil repellency of 5–6.

EXAMPLE 85

The procedure of Example 65 was followed with the substitution of Spin Finish-25 of Example 82 for Spin Finish-15 in the low temperature process. There was no separation of Spin Finish-25 in the finish circulation system; carpet made from polyamide yarn prepared in accordance with the present example had an oil repellency of 1.

EXAMPLE 86

The procedure of Example 82 was followed with the following changes: 17 parts of Fluorochemical Composition-1 were added to 7.2 parts of the solution of Example 1, and there were 914.3 parts of water. The emulsion formed is called Emulsion-10, and the spin finish formed is called Spin Finish-27, each being stable for at least 30 days.

EXAMPLE 87

The procedure of Example 83 is followed except that the number of parts are as follows: 17 parts of Fluorochemical Composition-1, 7.2 parts of the solution, 668.3 parts of water, and 307.5 parts of the second oil in water emulsion. The emulsions formed are called Emulsion-11 and Spin Finish-28, respectively, and they are each stable for at least 30 days.

EXAMPLE 88

The procedure of Example 64 was followed with the substitution of Spin Finish-27 of Example 86 for Spin Finish-15 in the high temperature spin-draw process. Spin Finish-27 was applied to the yarn at about 4.8 to 5.0 percent wet pickup to achieve about 0.075 percent by weight of yarn, of the fluorochemical compound, on the yarn after high temperature processing. There was no separation of Spin Finish-27 in the finish circulation system. Bulked yarn made in accordance with this example had a very good mechanical quality rating. Fabric made from polyamide yarn prepared in accordance with the present example had an oil repellency of 5–6.

EXAMPLES 89–95

The procedure of Example 40 is followed except that in lieu of Spin Finish-1 are substituted Spin Finish-15 of Example 62, Spin Finish-17 of Example 66, Spin Finish-19 of Example 70, Spin Finish-21 of Example 74, Spin Finish-23 of Example 78, Spin Finish-25 of Example 82 and Spin Finish-27 of Example 86 in each of, respectively, Examples 89, 90, 91, 92, 93, 94 and 95. Further, the spin finishes are applied to the yarn at about 4.8 to 5.0 percent wet pickup to achieve the percentages by weight of yarn, of the fluorochemical compound, on the yarn after high temperature processing as specified in the examples describing the respective formulations of the spin finishes. Bulked yarn made in accordance with each of these examples has an acceptable mechanical quality rating. Fabric made from polyethylene terephthalate yarn prepared in accordance with each of these examples is oil repellent.

EXAMPLE 96

Polyethylene terephthalate pellets are melted at about 280°–290° C. and are melt extruded under a pressure of about 2000–6000 psig. through a 70-orifice spinnerette to produce a yarn having about 3000–5000 undrawn denier. Spin Finish-15 of Example 62 is applied to the yarn as a spin finish via a kiss roll in amount to provide about 0.6 percent by weight of oil on the yarn. The yarn is subsequently creeled to form a tow, stretched, crimped, heat set, cut and baled. The staple fiber is made into carpets by conventional means. Carpet made in accordance with this example is oil repellent.

EXAMPLES 97–102

The procedure of Example 96 is followed except that in lieu of Spin Finish-15 are substituted Spin Finish-17 of Example 66, Spin Finish-19 of Example 70, Spin Finish-21 of Example 74, Spin Finish-23 of Example 78, Spin Finish-25 of Example 82 and Spin Finish-27 of Example 86 in each of, respectively, Examples 97, 98, 99, 100, 101 and 102. Carpet made from polyethylene terephthalate yarn prepared in accordance with each of Examples 97 through 100 is oil repellent, whereas with each of Examples 101 and 102, the yarn has very poor oil repellency.

EXAMPLE 103

The procedure of Example 59 is followed with the substitution of Emulsions 4 through 10 and Spin Finishes-15 through -27. Carpet made in accordance with this example wherein the heat setting temperatures are high are oil repellent. Carpet made in accordance with this example wherein the heat setting temperatures are low are also oil repellent except those fabricated from yarn which has been treated with Spin Finishes-25 and -27.

EXAMPLE 104

The procedure of Example 103 is followed except that the yarn is polyethylene terephthalate staple fiber which has a denier per filament of 12. Results are similar to those of Example 103.

DISCUSSION

As the preceding examples illustrate, the emulsions and spin finishes of the present invention render synthetic organic polymer yarn and/or yarn products with which they are incorporated oil repellent and resistant to soiling; in the case of Spin Finishes-25 and -27, oil repellency is apparently dependent on processing temperatures. The emulsions and spin finishes of the present invention exhibit exceptional emulsion stability. The examples (other than those in which Spin Finishes-25 or -27 are applied to yarn and followed by low temperature processing) which show little or no increase in soil repellency by virtue of utilizing the present invention in one of these forms, i.e., Examples 26, 27, 45 and 46, have as a common spin finish component hydrogenated castor oil, the presence of which has been found to seriously diminish oil repellency.

In Example 4, there were defined three critical stages for emulsion stability. Example 4 demonstrated the emulsion stability of the initial oil in water emulsion of the present invention. Examples 1, 2, 5, 6, 8, 9, 11, 12, 14, 15, 17, 20, 22, 62, 63, 66, 67, 70, 71, 74, 75, 78, 79, 82, 83, 86 and 87 demonstrate the second stage emulsion stability of, respectively, Spin Finishes-1, -2, -4, -5, -6, -7, -8, -9, -10, -11, -12, -13, -15, -16, -17, -18, -19, -20, -21, -22, -23, -24, -25, -26, -27, and -28. However, further examination of Examples 17, 20 and 22 shows that each of their respective Spin Finishes (-11, -12 and -13) gradually separates at the third stage, i.e., in the finish circulation system at the finish circulating pump. The remaining spin finishes, which survive the third stage, all comprise part of the present invention. Carpet made of yarn of this invention has soiling properties equal to or better than carpet with commercially available sprayed on soil repellent compositions. Some of the additional benefits afforded by the spin finish(es) of the present invention are:

(1) An even distribution of the finish on the yarn is readily achieved.

(2) The finish prevents static buildup on the yarn.

(3) Plasticity is imparted to the yarn.

In addition to the spin finishes of this invention, the emulsions labeled Emulsions 1 through 11 and variations thereof using the claimed salt of dioctyl sulfosuccinate and propylene glycol solution are also useful. They can be applied by spraying, padding or with a separate kiss roll or like method to fiber, yarn or yarn products.

What is claimed is:

1. An emulsion, comprising:

a. approximately 75 to 98.5 weight percent of water; and b. approximately 1.5 to 25 weight percent of a composition, said composition comprising:

i. about 15 to 80 weight percent of a solution of a salt of dioctyl sulfosuccinate, propylene glycol and water; and ii. about 20 to 85 weight percent of a fluorochemical compound having the formula

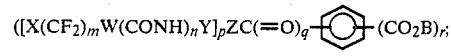

$$([X(CF_2)_mW(CONH)_nY]_pZC(=O)_q\text{-}C_6H_4\text{-}(CO_2B)_r;$$

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the same or different.

2. A spin finish for yarn, made from synthetic organic polymer, to be processed at high temperature into a yarn that is oil repellent and resistant to soiling, said spin finish comprising:

a. about 1.5 to 25 percent by weight of said spin finish of a first noncontinuous phase consisting essentially of i. about 15 to 80 weight percent of a solution of a salt of dioctyl sulfosuccinate, propylene glycol and water, and ii. about 20 to 85 weight percent of a fluorochemical compound having the formula

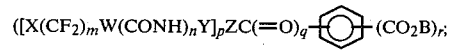

$$([X(CF_2)_mW(CONH)_nY]_pZC(=O)_q\text{-}C_6H_4\text{-}(CO_2B)_r;$$

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the same or different;

b. about 50 to 96 percent by weight of said spin finish of water; and c. about 2.5 to 25 percent by weight of said spin finish of a second noncontinuous phase which is capable of being emulsified with said first noncontinuous phase and said water without separation of any of the component parts of said spin finish.

3. The spin finish of claim 2 wherein none of the component parts of said spin finish separate during commercial processing of said yarn.

4. The spin finish of claim 2 wherein the fluorochemical compound is a trimellitate, a pyromellitate, or a bis(diamide)/ester of trimellitic acid or of pyromellitic acid, wherein each fluorinated radical, of formula $X(CF_2)_mW(CONH)_mY$, has a main chain containing at least six carbon atoms and contains at least four perfluorinated carbon atoms in the radical.

5. A polyamide yarn having incorporated therewith the spin finish of claim 4.

6. A polyester yarn having incorporated therewith the spin finish of claim 4.

7. The spin finish of claim 2 wherein the fluorochemical compound is a mixture of pyromellitates having the structure:

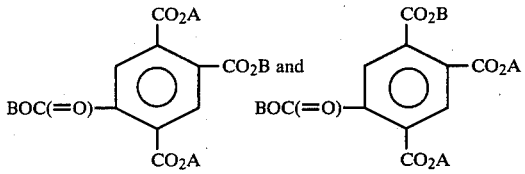

(a) para (50%) (b) meta (50%)

A = $(CH_2)_2(CF_2)_nCF_3$ where n is 5–13
B = $CH_2CHOHCH_2Cl$.

8. A polyamide yarn having incorporated therewith the spin finish of claim 7.

9. A polyester yarn having incorporated therewith the spin finish of claim 7.

10. The spin finish of claim 2 wherein said solution consists essentially of about 40 to 90 percent by weight of the salt of dioctyl sulfosuccinate, about 5 to 30 percent by weight of propylene glycol, and about 5 to 30 percent by weight of water.

11. A polyamide yarn having incorporated therewith the spin finish of claim 10.

12. A polyester yarn having incorporated therewith the spin finish of claim 10.

13. The spin finish of claim 2 wherein said solution consists essentially of about 70 percent by weight of the salt of dioctyl sulfosuccinate, about 16 percent by weight of propylene glycol, and about 14 percent by weight of water.

14. A polyamide yarn having incorporated therewith the spin finish of claim 13.

15. A polyester yarn having incorporated therewith the spin finish of claim 13.

16. The spin finish of claim 2 wherein said second noncontinuous phase is selected from the group consisting of:

a. about 40 to 65 percent by weight of coconut oil, about 15 to 35 percent by weight of polyoxyethylene oleyl ether containing about 5 to 20 moles of ethylene oxide per mole of oleyl alcohol, about 2 to 10 percent by weight of polyoxyethylene nonyl phenol containing about 5 to 15 moles of ethylene oxide per mole of nonyl phenol, and about 5 to 25 percent by weight of polyoxyethylene stearate containing about 4 to 15 moles of ethylene oxide per mole of stearic acid;

b. about 40 to 65 percent by weight of coconut oil, about 15 to 35 percent by weight of polyoxyethylene oleyl ether containing about 8 to 20 moles of ethylene oxide per mole of oleyl alcohol, about 2 to 10 percent by weight of polyoxyethylene oleate containing about 2 to 7 moles of ethylene oxide per mole of oleic acid, and about 5 to 25 percent by weight of polyoxyethylene castor oil containing about 2 to 10 moles of ethylene oxide per mole of castor oil;

c. about 40 to 65 percent by weight of mineral oil, about 5 to 15 percent by weight of a fatty acid soap, about 10 to 25 percent by weight of sulfonated ester ethoxylate, about 5 to 15 percent by weight of polyethylene glycol ester, about 2 to 10 percent by weight of polyethylene glycol ether, and about 0.5 to 2 percent by weight of triethanolamine;

d. about 40 to 60 percent by weight of white mineral oil, about 40 to 60 percent by weight of a salt of polyoxyethylene oleyl phosphate containing about 5 to 9 moles of ethylene oxide per mole of oleyl alcohol, and about 0.5 to 4 percent by weight of a salt of dinonyl sulfosuccinate;

e. about 40 to 50 percent by weight of an alkyl stearate wherein the alkyl group contains 4 to 18 carbon atoms, about 25 to 30 percent by weight of sorbitan monooleate, and about 25 to 30 percent by weight of polyoxyethylene tallow amine containing about 18 to 22 moles of ethylene oxide per mole of tallow amine;

f. about 20 to 70 percent by weight of coconut oil, about 10 to 50 percent by weight of polyoxyethylene oleyl ether containing about 5 to 20 moles of ethylene oxide per mole of oleyl alcohol, and about 5 to 30 percent by weight of polyoxyethylene stearate containing about 4 to 15 moles of ethylene oxide per mole of stearic acid;

g. about 12 to 45 percent by weight of polyoxyethylene laurate containing about 7 to 12 moles of ethylene oxide per mole of lauric acid, about 15 to 40 percent by weight of polyoxyethylene monoisostearate containing about 7 to 12 moles of ethylene oxide per mole of isostearic acid, about 2 to 8 percent by weight of polyoxyethylene tridecyl ether containing about 3 to 9 moles of ethylene oxide per mole of tridecyl alcohol, about 10 to 35 percent by weight of a salt of polyoxyethylene tridecyl alcohol phosphate containing about 3 to 7 moles of ethylene oxide per mole of tridecyl alcohol, and about 5 to 40 percent by weight of tridecyl stearate; and h. 100 percent by weight of a polyalkylene glycol ether.

17. A polyamide yarn having incorporated therewith the spin finish of claim 16.

18. A polyester yarn having incorporated therewith the spin finish of claim 16.

19. A polyamide yarn having incorporated therewith the spin finish of claim 2.

20. A polyester yarn having incorporated therewith the spin finish of claim 2.

21. A spin finish for yarn, made from synthetic organic polymer, to be processed at high temperature into a yarn that is oil repellent and resistant to soiling, said spin finish comprising:

a. about 2.4 to 10 percent by weight of said spin finish of a first noncontinuous phase consisting essentially of:

i. about 29 to 34 weight percent of a solution, said solution consisting essentially of about 70 percent by weight of sodium dioctyl sulfosuccinate, about 16 percent by weight of propylene glycol, and about 14 percent by weight of water, and ii. about 66 to 71 percent by weight of a fluorochemical compound, said fluorochemical compound having the formula

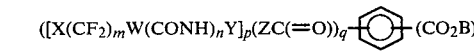

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the same or different;

b. about 80 to 93 percent by weight of said spin finish of water; and c. about 5 to 10 percent by weight of said spin finish of a second noncontinuous phase which is capable of being emulsified with said first noncontinuous phase and said water without separation of any of the component parts of said spin finish.

22. A polyamide yarn having incorporated therewith the spin finish of claim 21.

23. A polyester yarn having incorporated therewith the spin finish of claim 21.

24. The spin finish of claim 21 wherein said second noncontinuous phase is selected from the group consisting of:

a. about 55 percent by weight of coconut oil, about 25 percent by weight of polyoxyethylene oleyl ether containing about 10 moles of ethylene oxide per mole of oleyl alcohol, about 5 percent by weight of polyoxyethylene nonyl phenol containing about 9 moles of ethylene oxide per mole of nonyl phenol, and about 15 percent by weight of polyoxyethylene stearate containing about 8 moles of ethylene oxide per mole of stearic acid;

b. about 55 percent by weight of coconut oil, about 25 percent by weight of polyoxyethylene oleyl ether containing about 10 moles of ethylene oxide per mole of oleyl alcohol, about 5 percent by weight of polyoxyethylene oleate containing about 5 moles of ethylene oxide per mole of oleic acid, and about 15 percent by weight of polyoxyethylene castor oil containing about 5 moles of ethylene oxide per mole of castor oil;

c. about 55 percent by weight of mineral oil, about 11 percent by weight of a fatty acid soap, about 15 percent by weight of a sulfonated ester ethoxylate, about 12 percent by weight of polyoxyethylene glycol ester, about 6 percent by weight of polyethylene glycol ether, and about 1 percent by weight of triethanolamine;

d. about 50 percent by weight of white mineral oil, about 48 percent by weight of sodium salt of polyoxyethylene oleyl phosphate containing about 7 moles of ethylene oxide per mole of oleyl alcohol, and about 2 percent by weight of sodium dinonyl sulfosuccinate;

e. about 44.5 percent by weight of butyl stearate, about 27.75 percent by weight of sorbitan monooleate, and about 27.75 percent by weight of polyoxyethylene tallow amine containing about 20 moles of ethylene oxide per mole of tallow amine;

f. about 50 percent by weight of coconut oil, about 30 percent by weight of polyoxyethylene oleyl ether containing about 10 moles of ethylene oxide per mole of oleyl alcohol, and about 20 percent by weight of polyoxyethylene stearate containing about 8 moles of ethylene oxide per mole of stearic acid;

g. about 32 percent by weight of polyoxyethylene laurate containing about 9 moles of ethylene oxide per mole of lauric acid, about 27 percent by weight of polyoxyethylene monoisostearate containing about 9 moles of ethylene oxide per mole of isostearic acid, about 5 percent by weight of polyoxyethylene tridecyl ether containing about 6 moles of ethylene oxide per mole of tridecyl alcohol, about 27 percent by weight of potassium salt of polyoxyethylene tridecyl alcohol phosphate containing about 5 moles of ethylene oxide per mole of tridecyl alcohol, and about 9 percent by weight of tridecyl stearate; and h. 100 percent by weight of a polyalkylene glycol ether.

25. A polyamide yarn having incorporated therewith the spin finish of claim 24.

26. A polyester yarn having incorporated therewith the spin finish of claim 24.

27. A spin finish for yarn, made from synthetic organic polymer, to be processed at low temperature into a yarn that is oil repellent and resistant to soiling, said spin finish comprising:

a. about 2.6 to 25 percent by weight of said spin finish of a first noncontinuous phase consisting essentially of i. about 15 to 80 weight percent of a solution of a salt of dioctyl sulfosuccinate, propylene glycol and water, and ii. about 20 to 85 weight percent of a fluorochemical compound having the formula

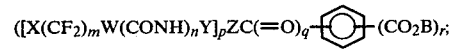

wherein the attachment of the fluorinated radicals and the radicals $CO_2B$ to the nucleus is in asymmetrical positions with respect to rotation about the axis through the center of the nucleus; wherein "X" is fluorine or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic;

and wherein the substituent chains of the above general formulas are the same or different;

b. about 50 to 95 percent by weight of said spin finish of water; and c. about 2.5 to 25 percent by weight of said spin finish of a second noncontinuous phase which is capable of being emulsified with said first noncontinuous phase and said water without separation of any of the component parts of said spin finish.

28. The spin finish of claim 27 wherein none of the component parts of said spin finish separate during commercial processing of said yarn.

29. The spin finish of claim 27 wherein the fluorochemical compound is a trimellitate, a pyromellitate, or a bis(diamide)/ester of trimellitic acid or of pyromellitic acid, wherein each fluorinated radical, of formula $X(CF_2)_mW(CONH)_nY$, has a main chain containing at least six carbon atoms and contains at least four perfluorinated carbon atoms in the radical.

30. A polyamide yarn having incorporated therewith the spin finish of claim 29.

31. A polyester yarn having incorporated therewith the spin finish of claim 29.

32. The spin finish of claim 27 wherein the fluorochemical compound is a mixture of pyromellitates having the structure:

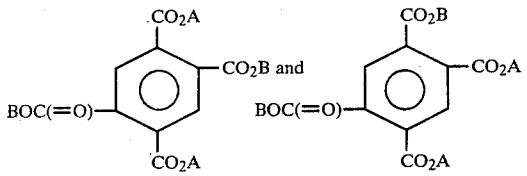

(a) para (50%) (b) meta (50%)

A = $(CH_2)_2(CF_2)_nCF_3$ where n is 5–13
B = $CH_2CHOHCH_2Cl$.

33. A polyamide yarn having incorporated therewith the spin finish of claim 32.

34. A polyester yarn having incorporated therewith the spin finish of claim 32.

35. The spin finish of claim 27 wherein said solution consists essentially of about 40 to 90 percent by weight of the salt of dioctyl sulfosuccinate, about 5 to 30 percent by weight of propylene glycol, and about 5 to 30 percent by weight of water.

36. A polyamide yarn having incorporated therewith the spin finish of claim 35.

37. A polyester yarn having incorporated therewith the spin finish of claim 35.

38. The spin finish of claim 27 wherein said solution consists essentially of about 70 percent by weight of the salt of dioctyl sulfosuccinate, about 16 percent by weight of propylene glycol, and about 14 percent by weight of water.

39. A polyamide yarn having incorporated therewith the spin finish of claim 38.

40. A polyester yarn having incorporated therewith the spin finish of claim 38.

41. The spin finish of claim 27 wherein said second noncontinuous phase is selected from the group consisting of:

a. about 40 to 65 percent by weight of coconut oil, about 15 to 35 percent by weight of polyoxyethylene oleyl ether containing about 5 to 20 moles of ethylene oxide per mole of oleyl alcohol, about 2 to 10 percent by weight of polyoxyethylene nonyl phenol containing about 5 to 15 moles of ethylene oxide per mole of nonyl phenol, and about 5 to 25 percent by weight of polyoxyethylene stearate containing about 4 to 15 moles of ethylene oxide per mole of stearic acid;

b. about 40 to 65 percent by weight of coconut oil, about 15 to 35 percent by weight of polyoxyethylene oleyl ether containing about 8 to 20 moles of ethylene oxide per mole of oleyl alcohol, about 2 to 10 percent by weight of polyoxyethylene oleate containing about 2 to 7 moles of ethylene oxide per mole of oleic acid, and about 5 to 25 percent by weight of polyoxyethylene castor oil containing about 2 to 10 moles of ethylene oxide per mole of castor oil;

c. about 40 to 65 percent by weight of mineral oil, about 5 to 15 percent by weight of a fatty acid soap, about 10 to 25 percent by weight of sulfonated ester ethoxylate, about 5 to 15 percent by weight of polyethylene glycol ester, about 2 to 10 percent by weight of polyethylene glycol ether, and about 0.5 to 2 percent by weight of triethanolamine;

d. about 40 to 60 percent by weight of white mineral oil, about 40 to 60 percent by weight of a salt of polyoxyethylene oleyl phosphate containing about 5 to 9 moles of ethylene oxide per mole of oleyl alcohol, and about 0.5 to 4 percent by weight of a salt of dinonyl sulfosuccinate;

e. about 40 to 50 percent by weight of an alkyl stearate wherein the alkyl group contains 4 to 18 carbon atoms, about 25 to 30 percent by weight of sorbitan monooleate, and about 25 to 30 percent by weight of polyoxyethylene tallow amine containing about 18 to 22 moles of ethylene oxide per mole of tallow amine;

f. about 20 to 70 percent by weight of coconut oil, about 10 to 50 percent by weight of polyoxyethylene oleyl ether containing about 5 to 20 moles of ethylene oxide per mole of oleyl alcohol, and about 5 to 30 percent by weight of polyoxyethylene stearate containing about 4 to 15 moles of ethylene oxide per mole of stearic acid;

g. about 12 to 45 percent by weight of polyoxyethylene laurate containing about 7 to 12 moles of ethylene oxide per mole of lauric acid, about 15 to 40 percent by weight of polyoxyethylene monoisostearate containing about 7 to 12 moles of ethylene oxide per mole of isostearic acid, about 2 to 8 percent by weight of polyoxyethylene tridecyl ether containing about 3 to 9 moles of ethylene oxide per mole of tridecyl alcohol, about 10 to 35 percent by weight of a salt of polyoxyethylene tridecyl alcohol phosphate containing about 3 to 7 moles of ethylene oxide per mole of tridecyl alcohol, and about 5 to 40 percent by weight of tridecyl stearate; and h. 100 percent by weight of a polyalkylene glycol ether.

42. A polyamide yarn having incorporated therewith the spin finish of claim 41.

43. A polyester yarn having incorporated therewith the spin finish of claim 41.

44. A polyamide yarn having incorporated therewith the spin finish of claim 27.

45. A polyester yarn having incorporated therewith the spin finish of claim 27.

46. A spin finish for yarn, made from synthetic organic polymer, to be processed at low temperature into a yarn that is oil repellent and resistant to soiling, said spin finish comprising:

a. about 3.8 to 10 percent by weight of said spin finish of a first noncontinuous phase consisting essentially of:

i. about 29 to 34 weight percent of a solution, said solution consisting essentially of about 70 percent by weight of sodium dioctyl sulfosuccinate, about 16 percent by weight of propylene glycol, and about 14 percent by weight of water, and ii. about 66 to 71 weight percent of a fluorochemical compound, said fluorochemical compound having the formula

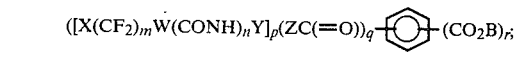

$$([X(CF_2)_mW(CONH)_nY]_p(ZC(=O))_q\text{-}C_6H_4\text{-}(CO_2B)_r;$$

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 to 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and P is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the same or different;

b. about 80 to 92 percent by weight of said spin finish of water; and c. about 5 to 10 percent by weight of said spin finish of a second noncontinuous phase which is capable of being emulsified with said first noncontinuous phase and said water without separation of any of the component parts of said spin finish.

47. A polyamide yarn having incorporated therewith the spin finish of claim 46.

48. A polyester yarn having incorporated therewith the spin finish of claim 46.

49. The spin finish of claim 46 wherein said second noncontinuous phase is selected from the group consisting of:

a. about 55 percent by weight of coconut oil, about 25 percent by weight of polyoxyethylene oleyl ether containing about 10 moles of ethylene oxide per mole of oleyl alcohol, about 5 percent by weight of polyoxyethylene nonyl phenol containing about 9 moles of ethylene oxide per mole of nonyl phenol, and about 15 percent by weight of polyoxyethylene stearate containing about 8 moles of ethylene oxide per mole of stearic acid;

b. about 55 percent by weight of coconut oil, about 25 percent by weight of polyoxyethylene oleyl ether containing about 10 moles of ethylene oxide per mole of oleyl alcohol, about 5 percent by weight of polyoxyethylene oleate containing about 5 moles of ethylene oxide per mole of oleic acid, and about 15 percent by weight of polyoxyethylene castor oil containing about 5 moles of ethylene oxide per mole of castor oil;

c. about 55 percent by weight of mineral oil, about 11 percent by weight of a fatty acid soap, about 15 percent by weight of a sulfonated ester ethoxylate, about 12 percent by weight of polyethylene glycol ester, about 6 percent by weight of polyethylene glycol ether, and about 1 percent by weight of triethanolamine;

d. about 50 percent by weight of white mineral oil, about 48 percent by weight of sodium salt of polyoxyethylene oleyl phosphate containing about 7 moles of ethylene oxide per mole of oleyl alcohol, and about 2 percent by weight of sodium dinonyl sulfosuccinate;

e. about 44.5 percent by weight of butyl stearate, about 27.75 percent by weight of sorbitan monooleate, and about 27.75 percent by weight of polyoxyethylene tallow amine containing about 20 moles of ethylene oxide per mole of tallow amine;

f. about 50 percent by weight of coconut oil, about 30 percent by weight of polyoxyethylene oleyl ether containing about 10 moles of ethylene oxide per mole of oleyl alcohol, and about 20 percent by weight of polyoxyethylene stearate containing about 8 moles of ethylene oxide per mole of stearic acid;

g. about 32 percent by weight of polyoxyethylene laurate containing about 9 moles of ethylene oxide per mole of lauric acid, and 27 percent by weight of polyoxyethylene monoisostearate containing about 9 moles of ethylene oxide per mole of isostearic acid, about 5 percent by weight of polyoxyethylene tridecyl ether containing about 6 moles of ethylene oxide per mole of tridecyl alcohol, about 27 percent by weight of potassium salt of polyoxyethylene tridecyl alcohol phosphate containing about 5 moles of ethylene oxide per mole of tridecyl alcohol, and about 9 percent by weight of tridecyl stearate; and h. 100 percent by weight of a polyethylene glycol ether.

50. A polyamide yarn having incorporated therewith the spin finish of claim 49.

51. A polyester yarn having incorporated therewith the spin finish of claim 49.

* * * * *